US012024268B2

(12) United States Patent
Jones et al.

(10) Patent No.: US 12,024,268 B2
(45) Date of Patent: Jul. 2, 2024

(54) MODULAR BOAT

(71) Applicants: Vincent F. Jones, Cedar Hills, UT (US); Matt Free, American Fork, UT (US); Bob West, Orem, UT (US)

(72) Inventors: Vincent F. Jones, Cedar Hills, UT (US); Matt Free, American Fork, UT (US); Bob West, Orem, UT (US)

( * ) Notice: Subject to any disclaimer, the term of this patent is extended or adjusted under 35 U.S.C. 154(b) by 468 days.

(21) Appl. No.: 17/535,755

(22) Filed: Nov. 26, 2021

(65) Prior Publication Data

US 2022/0177078 A1 Jun. 9, 2022

Related U.S. Application Data

(60) Provisional application No. 63/225,479, filed on Jul. 24, 2021, provisional application No. 63/122,516, filed on Dec. 8, 2020.

(51) Int. Cl.
*B63B 7/04* (2020.01)
*B63B 3/08* (2006.01)

(52) U.S. Cl.
CPC . *B63B 7/04* (2013.01); *B63B 3/08* (2013.01)

(58) Field of Classification Search
CPC ..... B63B 7/04; B63B 3/08
See application file for complete search history.

(56) References Cited

U.S. PATENT DOCUMENTS 157,546 A * 12/1874 Schaal ..... B63B 35/12 114/42
1,920,036 A * 7/1933 Stoner ..... A63B 35/10 114/283
2,432,857 A * 12/1947 Briggs ..... B63H 5/16 114/148
2,589,087 A * 3/1952 Jarvi ..... B63B 7/06 114/354
3,426,716 A * 2/1969 Hackworth ..... B63B 1/121 114/267
3,593,684 A * 7/1971 Cogliano ..... B63B 7/04 114/39.28
5,692,450 A * 12/1997 Alter ..... B63B 34/05 114/61.15
7,587,986 B2 * 9/2009 Neidert ..... B63B 34/50 114/61.15
8,074,593 B2 * 12/2011 Hansen ..... B63B 1/121 114/364
11,952,086 B2 * 4/2024 Roche ..... B63B 34/50

FOREIGN PATENT DOCUMENTS

CN 102781769 A * 11/2012 ..... B63B 7/082

* cited by examiner

*Primary Examiner* — S. Joseph Morano
*Assistant Examiner* — Jovon E Hayes

(57) ABSTRACT

A modular boat can be adapted to meet various desired shapes and uses, and can be transportable. The modular boat can include multiple sections configured to be joined together by rod-connection(s), by interlock-connection(s), or both. Each section can be joined to other section(s) to form and use the modular boat, and can be separated from the other section(s) for transportation. Each section can extend from bow to stern and can be joined to the other section(s) at a junction extending from bow to stern. Each rod-connection can include a hole extending perpendicular to the junction, through the sections across the modular boat, and a rod extending through the hole. Each interlock-connection can include a a key inserted into a slot of an adjacent section at the junction.

20 Claims, 16 Drawing Sheets

MODULAR BOAT

CLAIM OF PRIORITY

This application claims priority to U.S. Provisional Patent Application No. 63/122,516, filed on Dec. 8, 2020, and U.S. 63/225,479, filed on Jul. 24, 2021, which are incorporated herein by reference.

FIELD OF THE INVENTION

The present application is related generally to small, lightweight boats, such as canoes and kayaks.

BACKGROUND

There are many possible shapes and uses of small boats. It would be useful to provide a boat that can be adapted to meet desired shapes and uses. It can be difficult to transport a boat. It would be useful to improve boat transportability.

BRIEF DESCRIPTION OF THE DRAWINGS (DRAWINGS MIGHT NOT BE DRAWN TO SCALE)

FIG. 1 is a top-view of a modular boat 10 with multiple sections 11 and multiple holes 12. Each hole 12 extends through all of the multiple sections 11. The multiple sections 11 can be joined together by rods 22 (see FIG. 2) to form rod-connections 32 (see FIG. 3).

FIG. 2 shows sections of a rod 22 capable of being joined together to form a rod-connection 32 (see FIG. 3) in a modular boat. The rod 22 has a locking-rod-end $\mathbf{22}_L$ and a round-rod-end $\mathbf{22}_R$. The round-rod-end $\mathbf{22}_R$ can be rotated to shorten rod 22 length. Shortening the rod 22 can pull the locking-rod-end $\mathbf{22}_L$ and the round-rod-end $\mathbf{22}_R$ towards each other, and pressing the multiple sections 11 of the modular boat together.

FIG. 3 is a top-view of a modular boat 30 with multiple sections 11 joined together by rod-connections 32.

FIG. 4 shows sections of a rod 22 assembled together as it would be in the rod-connection 32 of FIG. 3.

FIG. 5 is a top-view of a modular boat 50 with multiple sections 11 joined together by rod-connections 32, including two center-sections $\mathbf{11}_c$ between two outer-sections $\mathbf{11}_o$.

Figure 8:
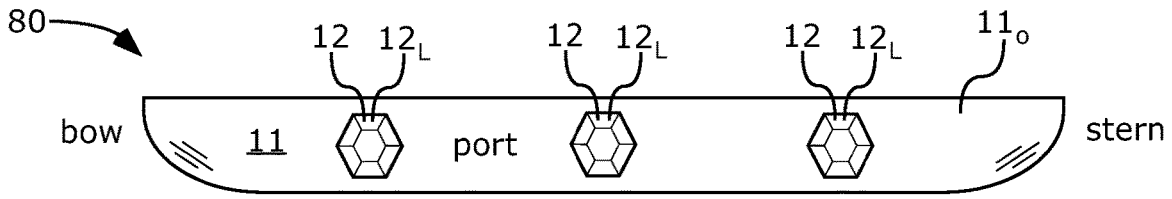

FIG. 8 is a port-side view of a modular boat 80 with multiple sections 11 and multiple holes 12. Each hole 12 extends through all of the multiple sections 11. Each hole 12 at the port-side includes a locking-hole-end $\mathbf{12}_L$ with multiple sides.

Figure 9:
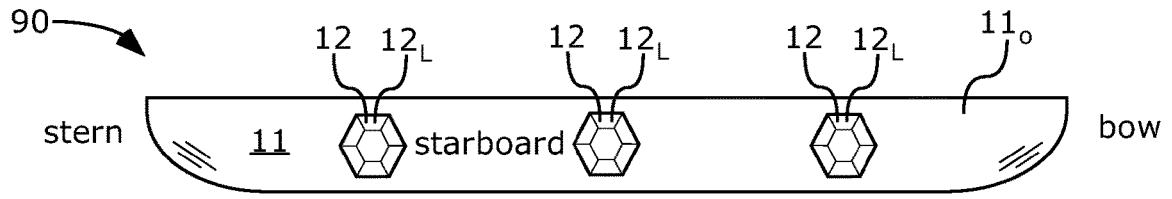

FIG. 9 is a starboard-side view of a modular boat 90 with multiple sections 11 and multiple holes 12. Each hole 12 extends through all of the multiple sections 11. Each hole 12 at the starboard-side includes a locking-hole-end $\mathbf{12}_L$ with multiple sides.

Figure 10:
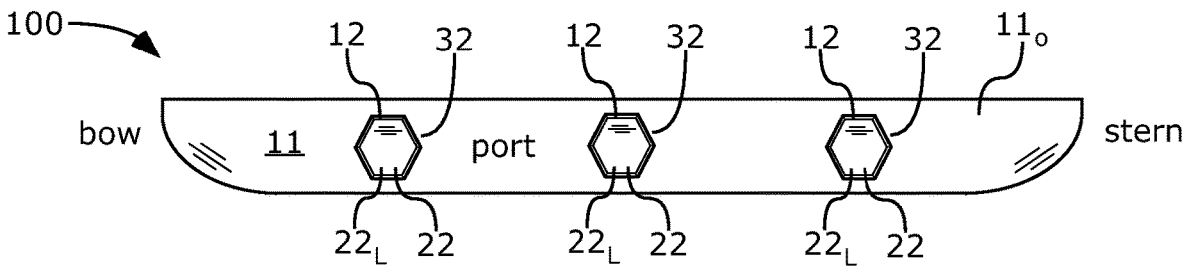

FIG. 10 is a port-side view of a modular boat 100 with multiple sections 11 and multiple holes 12. Each hole 12 extends through all of the multiple sections 11. A locking-rod-end $\mathbf{22}_L$ of each rod 22 is in a locking-hole-end $\mathbf{12}_L$ of the hole 12.

Figure 11:
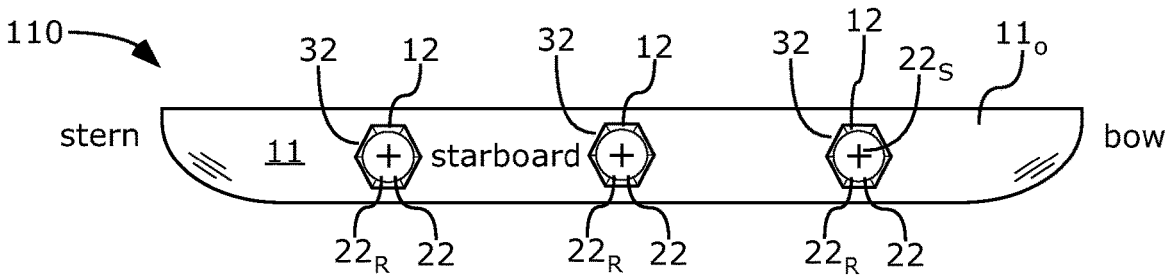

FIG. 11 is a starboard-side view of a modular boat 110 with multiple sections 11 and multiple holes 12. Each hole extends through all of the multiple sections 11. A round-rod-end $\mathbf{22}_R$ of each rod 22 is in a locking-hole-end $\mathbf{12}_L$ of the hole 12.

Figure 12:
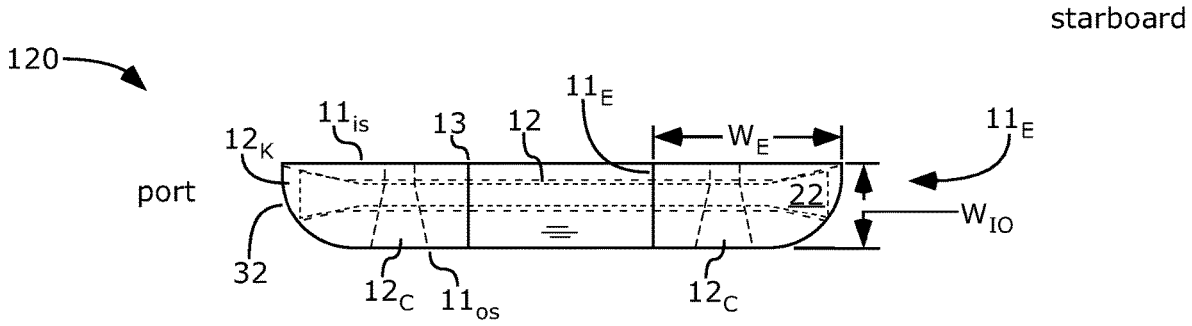

FIG. 12 is an end-view of a modular boat 120 with multiple sections 11, including a center-section $\mathbf{11}_c$ between two outer-sections $\mathbf{11}_o$. Each outer-section $\mathbf{11}_o$ has a kayak-hole $\mathbf{12}_K$ extending from one edge $\mathbf{11}_E$ to an opposite edge $\mathbf{11}_E$. The kayak-hole $\mathbf{12}_K$ of each outer-section $\mathbf{11}_o$ is aligned with the hole 12 through the center-section $\mathbf{11}_c$. The rod 22 extends through the kayak-hole $\mathbf{12}_K$ and through the hole 12 in the center-section $\mathbf{11}_c$. The modular boat 120 has a kayak-configuration.

Figure 13:
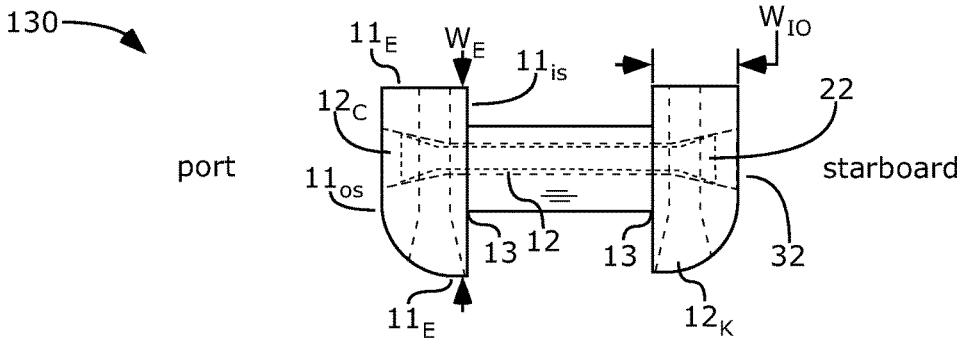

FIG. 13 is an end-view of a modular boat 130 with multiple sections 11, including a center-section $\mathbf{11}_o$ between two outer-sections $\mathbf{11}_o$. Each outer-section $\mathbf{11}_o$ has a catamaran-hole $\mathbf{12}_C$ extending from an inner-side $\mathbf{11}_{is}$ to the outer-side $\mathbf{11}_{is}$. The catamaran-hole $\mathbf{12}_C$ of each outer-section $\mathbf{11}_o$ is aligned with the hole 12 through the center-section $\mathbf{11}_c$. The rod 22 extends through the catamaran-hole 12*c* and through the hole 12 in the center-section $\mathbf{11}_c$. The modular boat 120 has a catamaran-configuration.

Figure 14:
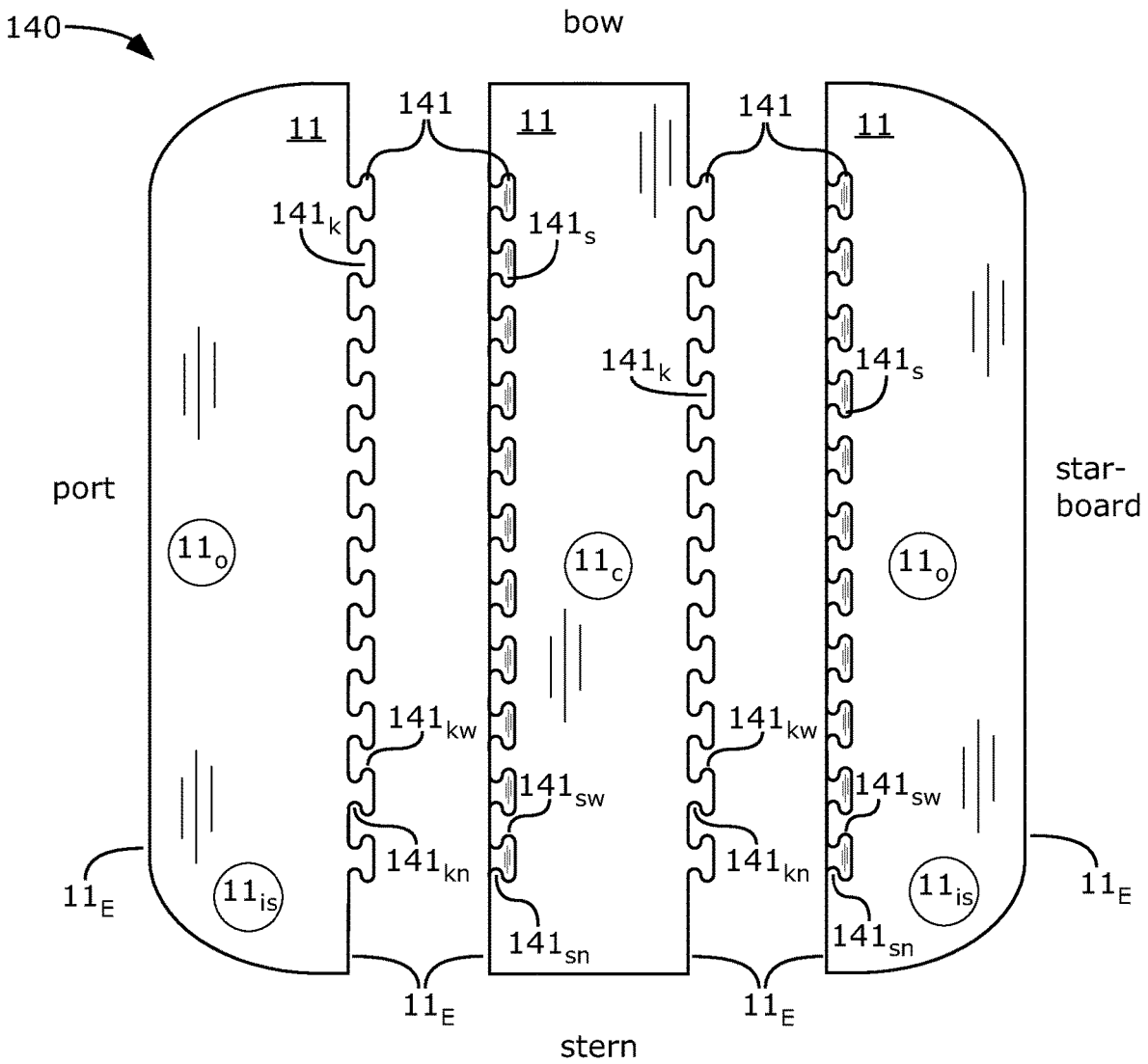

FIG. 14 is a top-view of multiple sections 11 for a modular boat 140. Each section 11 includes an array of keys $\mathbf{141}_k$, an array of slots $\mathbf{141}_s$, or both. Each key $\mathbf{141}_k$ and each slot $\mathbf{141}_s$ is capable of interlocking with a slot $\mathbf{141}_s$ or a key $\mathbf{141}_k$ on an adjacent section 11 to form an interlock-connection 141.

Figure 15:
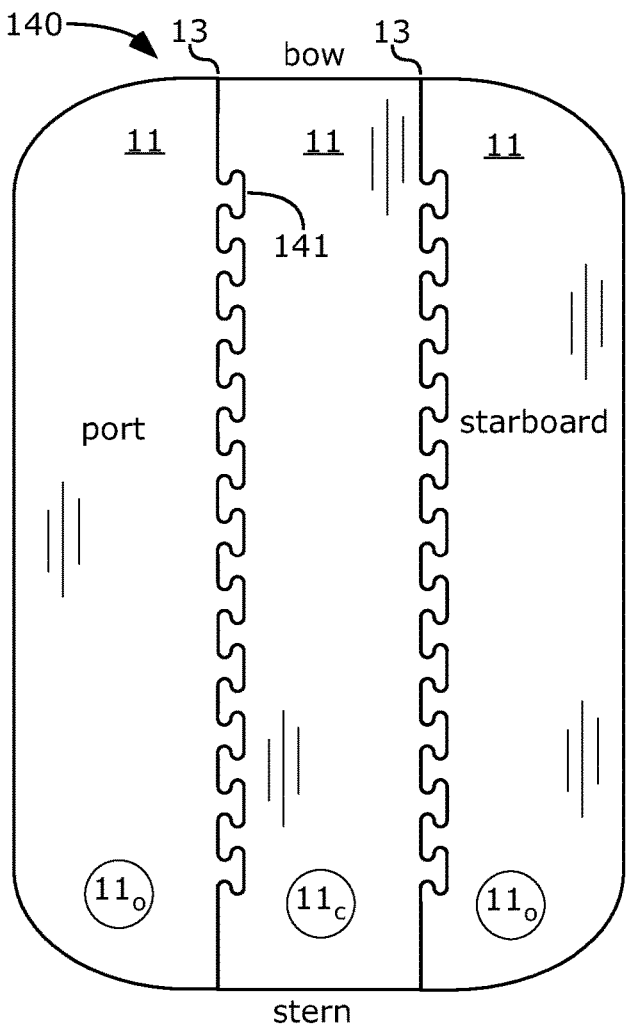

FIG. 15 is a top-view of a modular boat 150 with multiple sections 11, including a center-section $\mathbf{11}_c$ between two outer-sections $\mathbf{11}_o$. The multiple sections 11 are joined together by interlock-connections 141.

Figure 16:
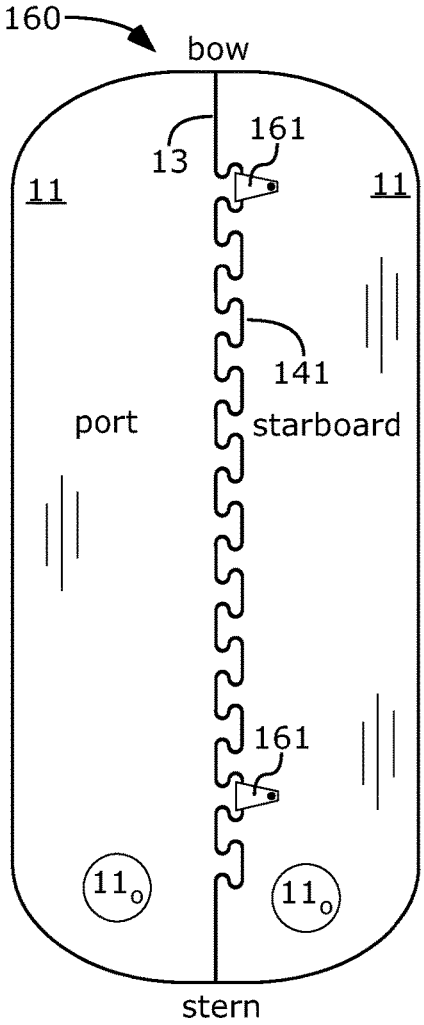

FIG. 16 is a top-view of a modular boat 160 with two adjoining outer-sections $\mathbf{11}_o$ joined together by interlock-connections 141.

Figure 17:
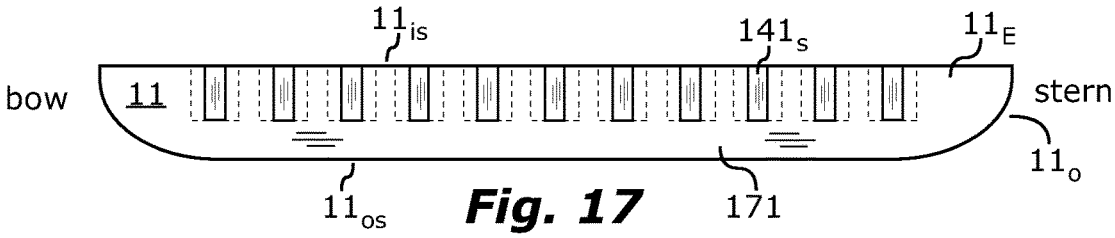

FIG. 17 is a side-view of an outer-section $\mathbf{11}_o$ for the starboard side of a modular boat, showing an array of slots $\mathbf{141}_s$ capable of interlocking with an array of keys $\mathbf{141}_k$ on an adjacent section 11 to form interlock-connections 141.

Figure 18:
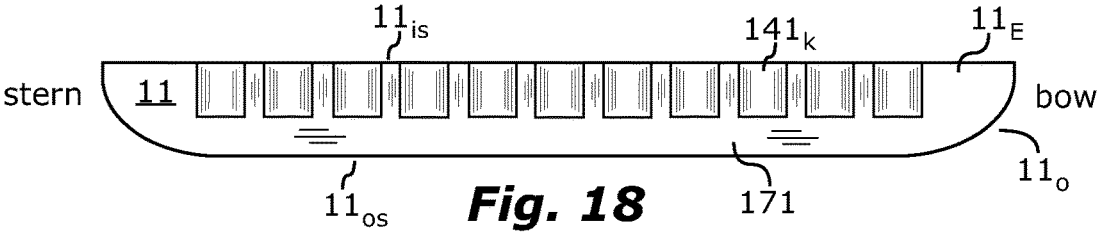

FIG. 18 is a side-view of an outer-section $\mathbf{11}_o$ for the port side of a modular boat, showing an array of keys $\mathbf{141}_k$ capable of interlocking with an array of slots $\mathbf{141}_s$ on an adjacent section 11 to form interlock-connections 141.

Figure 19:
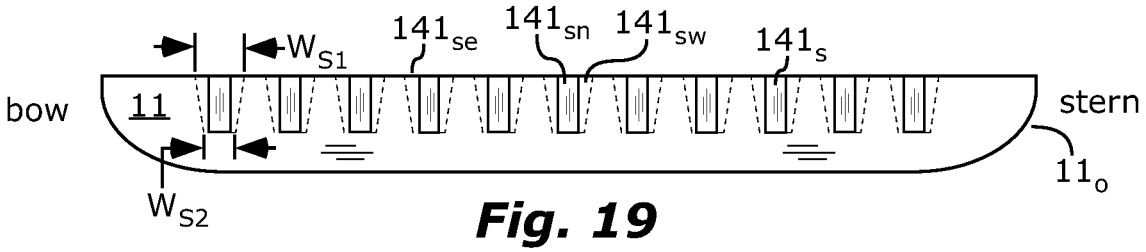

FIG. 19 is a side-view of an outer-section $\mathbf{11}_o$ for the starboard side of a modular boat, showing an array of slots $\mathbf{141}_s$ capable of interlocking with an array of keys $\mathbf{141}_k$ on an adjacent section 11 to form interlock-connections 141. A wide-channel $\mathbf{141}_{sw}$ of each slot $\mathbf{141}_s$ has a taper—a larger width $W_{S1}$ at an entry region $\mathbf{141}_{se}$ of the slot $\mathbf{141}_s$ tapers down to a smaller width $W_{S2}$ farther from the entry region $\mathbf{141}_{se}$.

Figure 20:
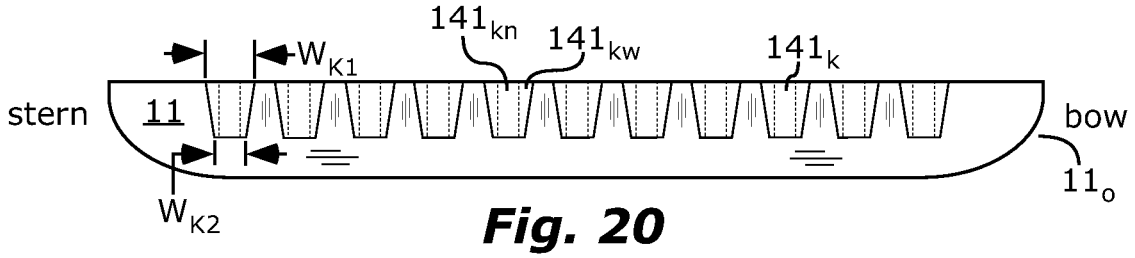

FIG. 20 is a side-view of an outer-section $\mathbf{11}_o$ for the port side of a modular boat, showing an array of keys $\mathbf{141}_k$ capable of interlocking with an array of slots $\mathbf{141}_s$ on an adjacent section 11 to form interlock-connections 141. A wide-region $\mathbf{141}_{kw}$ of each key $\mathbf{141}_k$ has a taper, matching the taper of the slot $\mathbf{141}_s$, with a larger width $W_{k1}$ at one end and tapering down to a smaller width $W_{k2}$.

Figure 21:
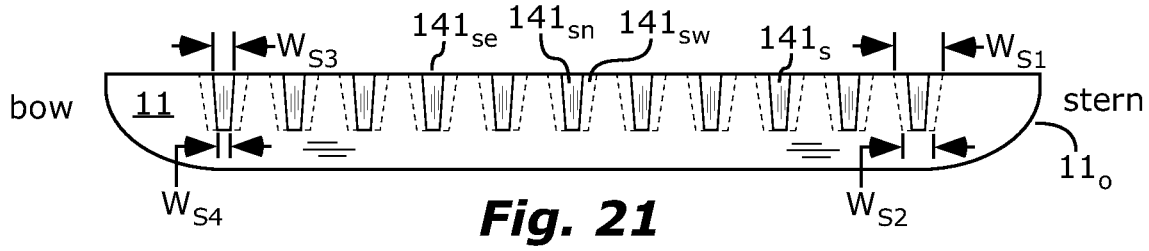

FIG. 21 is a side-view of an outer-section $\mathbf{11}_o$ for the starboard side of a modular boat, showing an array of slots $\mathbf{141}_s$ capable of interlocking with an array of keys $\mathbf{141}_k$ on an adjacent section 11 to form interlock-connections 141. A wide-channel $\mathbf{141}_{sw}$ and a narrow-channel $\mathbf{141}_{sn}$ of each slot $\mathbf{141}_s$ each has a taper. The narrow-channel $\mathbf{141}_{sn}$ has a larger width $W_{S3}$ at an entry region $\mathbf{141}_{se}$ of the slot $\mathbf{141}_s$ and tapers down to a smaller width $W_{S4}$ farther from the entry region $\mathbf{141}_{se}$.

Figure 22:
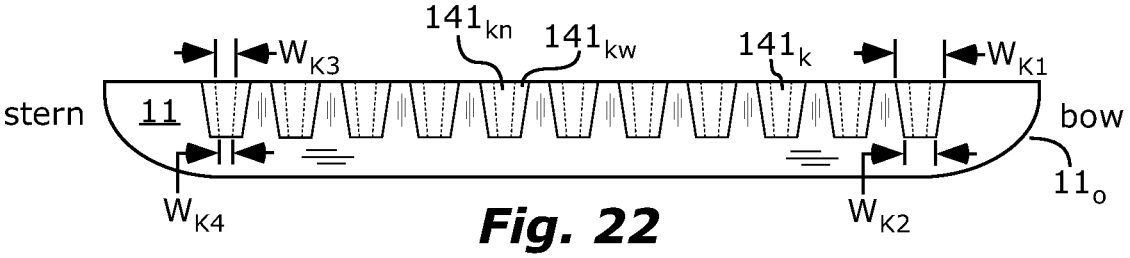

FIG. 22 is a side-view of an outer-section $\mathbf{11}_o$ for the port side of a modular boat, showing an array of keys $\mathbf{141}_k$ capable of interlocking with an array of slots $141_s$ on an adjacent section 11 to form interlock-connections 141. A wide-region $141_{kw}$ and a narrow-region $141_{kn}$ of each key $141_k$ each has a taper, matching the taper of the slot $141_s$. The narrow-region $141_{kn}$ has a larger width $W_{k3}$ at one end, and tapers down to a smaller width $W_{k4}$.

Figure 23:
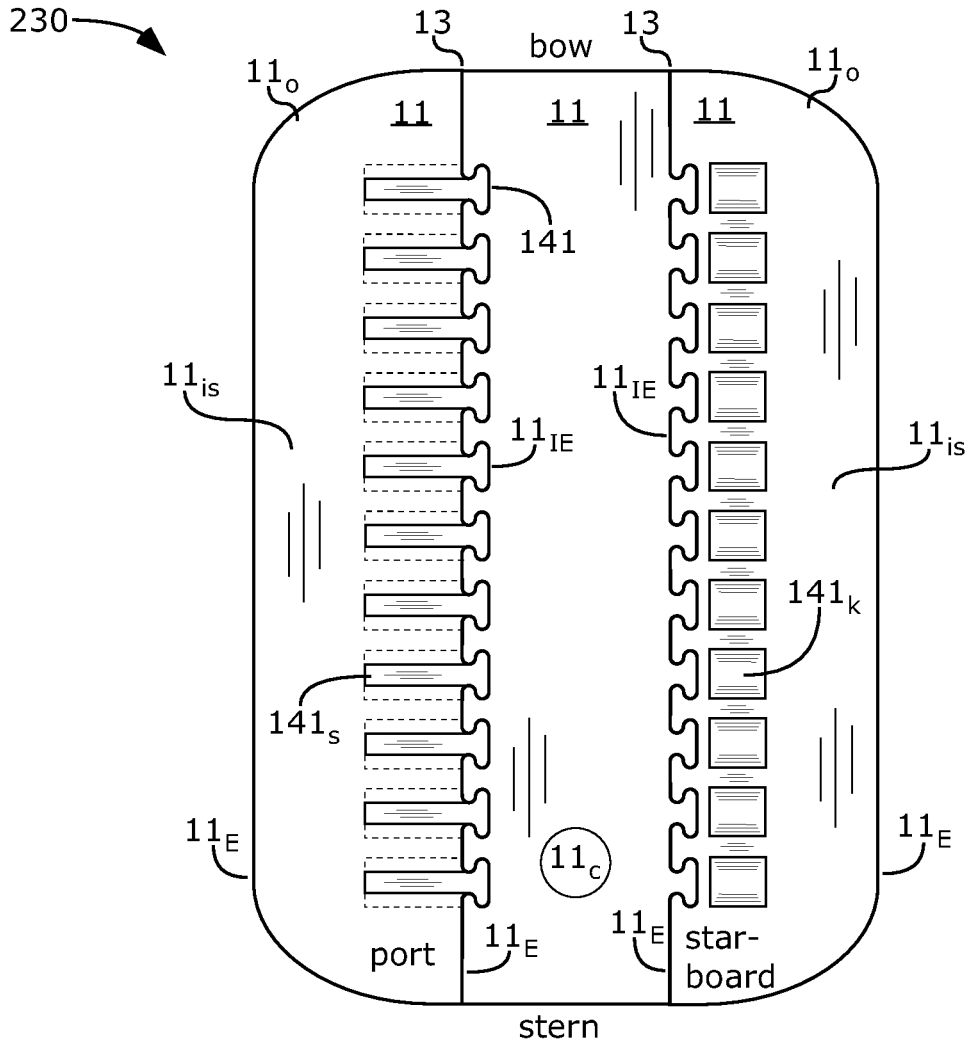

FIG. 23 is a top-view of a modular boat 230 with multiple sections 11, including a center-section $11_c$ between two outer-sections $11_o$. Each outer-section $11_o$ includes an inner-side $11_{is}$ and an outer-side $11_{os}$ (bottom side) opposite of each other, and two opposite edges $11_E$ extending between the inner-side $11_{is}$ and the outer-side $11_{os}$. Each outer-section $11_o$ has an array of keys $141_k$ or an array of slots $141_s$ for the interlock-connection 141 on the inner-side $11_{is}$ and on one of the two opposite edges $11_E$. The modular boat has a kayak-configuration with the inner-edge $11_E$ of each outer-section $11_o$ forming part of the interlock-connection 141.

Figure 24:
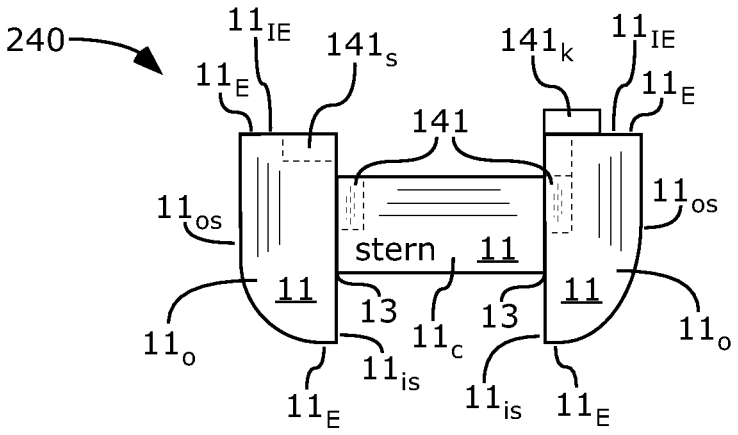

FIG. 24 is an end-view of a modular boat 120 with multiple sections 11, including a center-section $11_c$ between two outer-sections $11_o$. Each outer-section $11_o$ includes an inner-side $11_{is}$ and an outer-side $11_{os}$ opposite of each other, and two opposite edges $11_E$ extending between the inner-side $11_{is}$ and the outer-side $11_{os}$. Each outer-section $11_o$ has an array of keys $141_k$ or an array of slots $141_k$ for the interlock-connection 141 on the inner-side $11_{is}$ and on one of the two opposite edges $11_E$. The modular boat has a catamaran-configuration with the inner-side $11_{is}$ of the outer-sections $11_o$ facing each other and the keys $141_k$, slots $141_s$, or both on the inner-sides $11_{is}$ of the outer-sections $11_o$ forming part of the interlock-connection 141.

Figure 25:
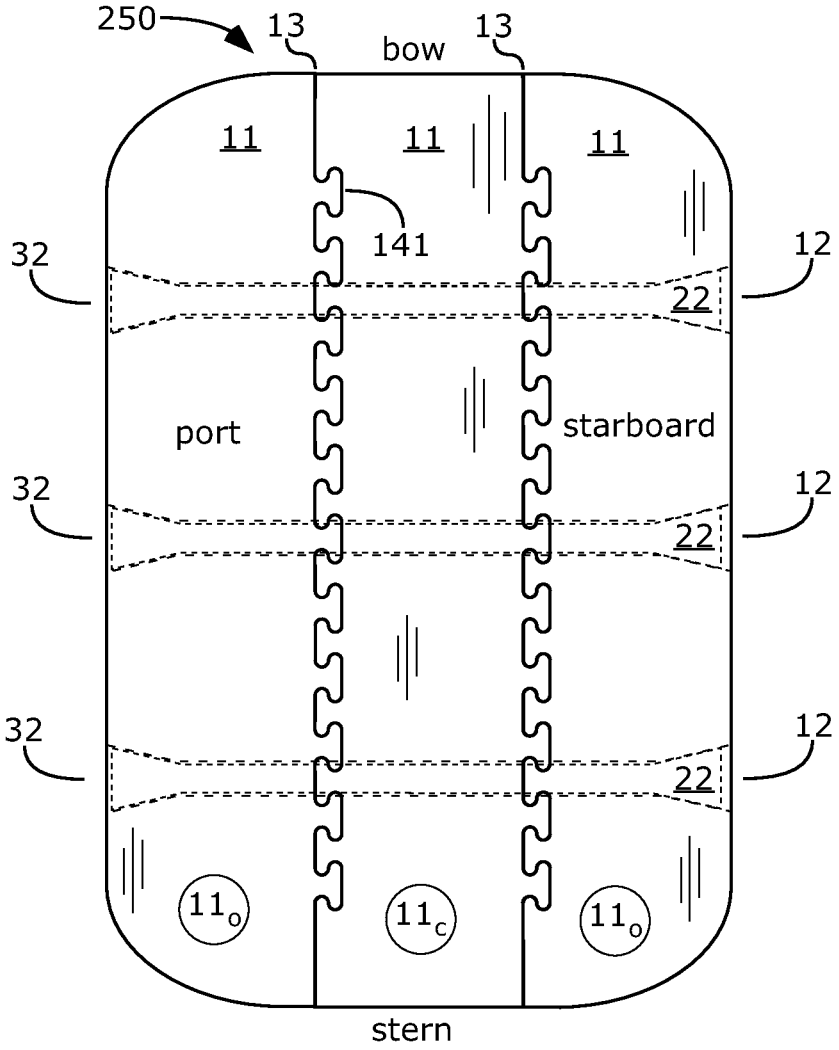

FIG. 25 is a top-view of a modular boat 10 with multiple sections 11 joined together by rod-connection(s) 32 and by interlock-connection(s) 141.

Figure 26:
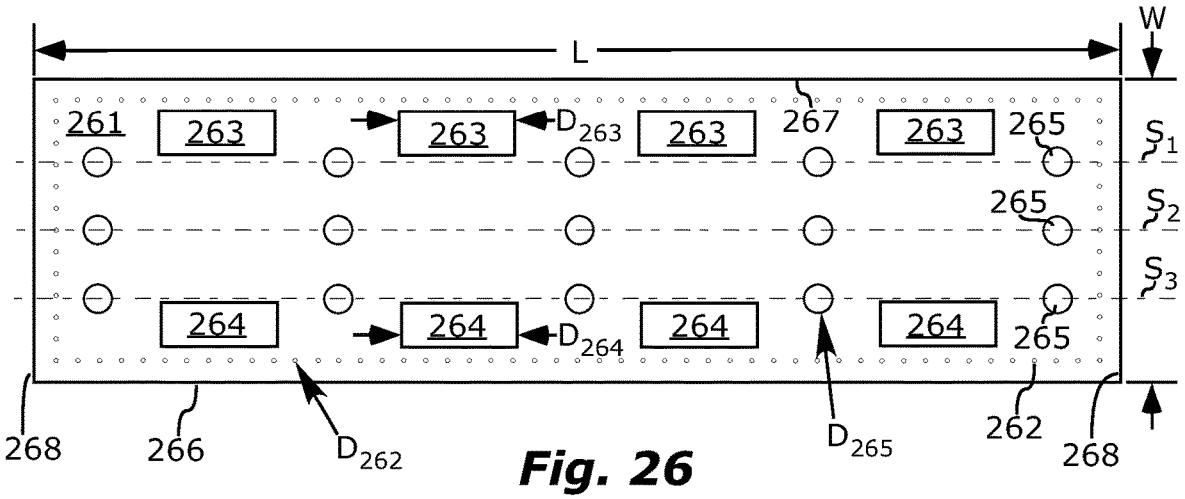

FIG. 26 is a side-view of a plate 261 for a removable roof rack.

Figure 27:
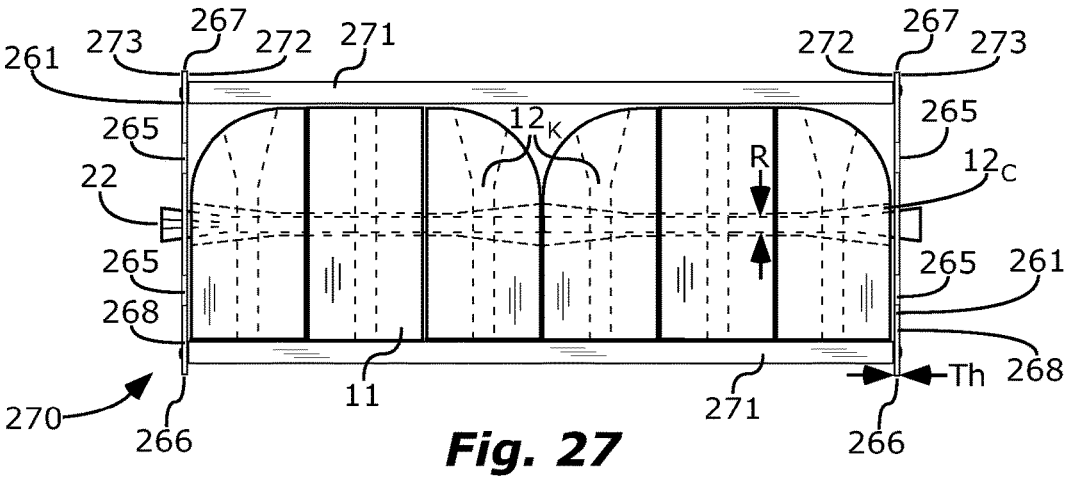

FIG. 27 is an end-view of multiple sections 11 for modular boats on a removable roof rack 270. The rack includes two separate plates 261 facing each other. Rods 22 extend through catamaran-holes $12_C$ in the sections 11 and through holes 265 in the plates 261.

Figure 28:
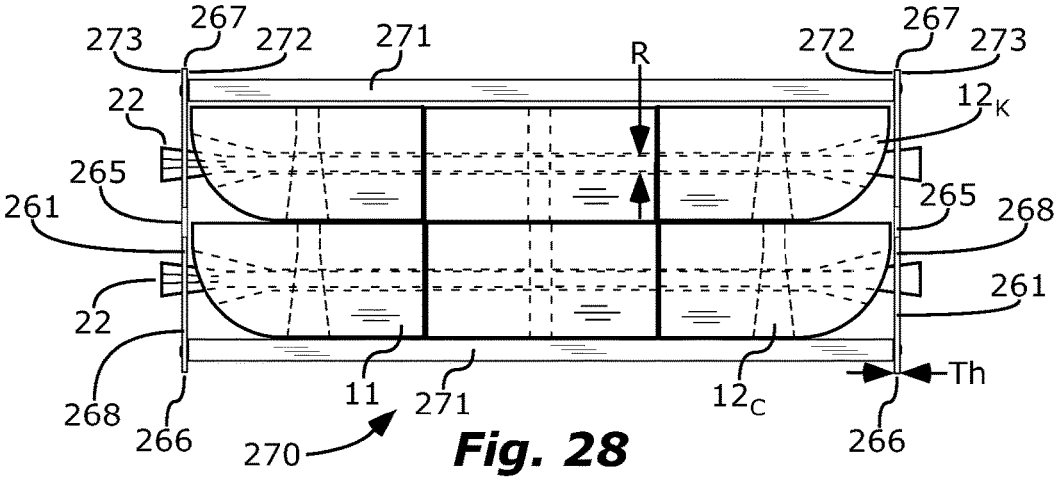

FIG. 28 is an end-view of multiple sections 11 for modular boats on a removable roof rack 270, the rack includes two separate plates 261 facing each other. Rods 22 extend through kayak-holes $12_K$ in the sections 11 and through holes 265 in the plates 261.

Figure 29:
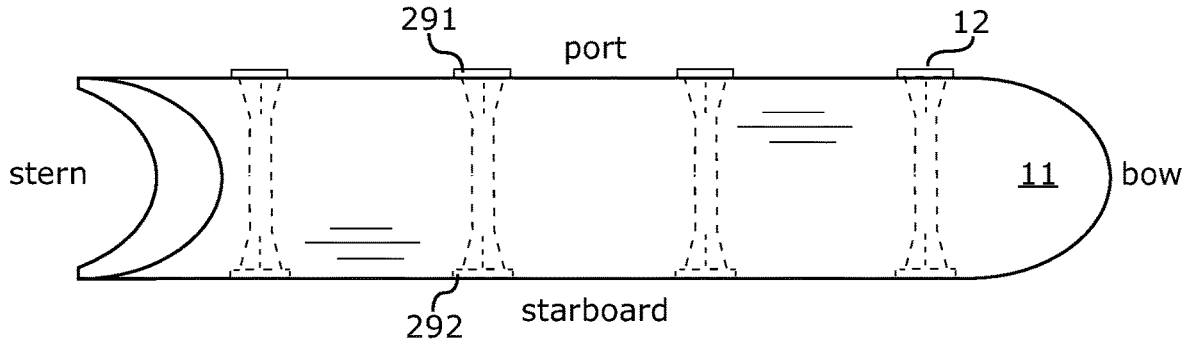

FIG. 29 is a top-view of a modular boat section 11 with (a) multiple holes 12 extending between port and starboard, and (b) a bow with a convex shape and a stern with a matching concave shape.

Figure 30:
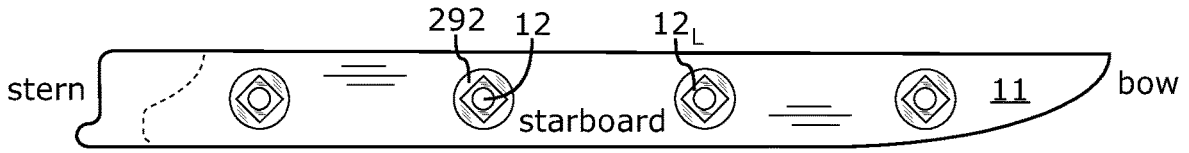

FIG. 30 is a starboard side-view of the modular boat section 11 of FIG. 29 with a locking-hole-end $12_L$ with multiple sides at the end of each hole 12.

Figure 31:
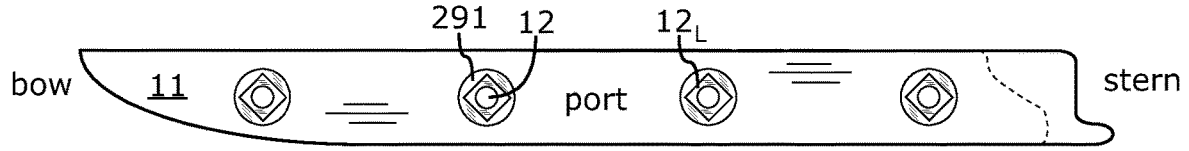

FIG. 31 is a port side-view of the modular boat section 11 of FIG. 29 with a locking-hole-end $12_L$ with multiple sides at the end of each hole 12.

Figure 32:
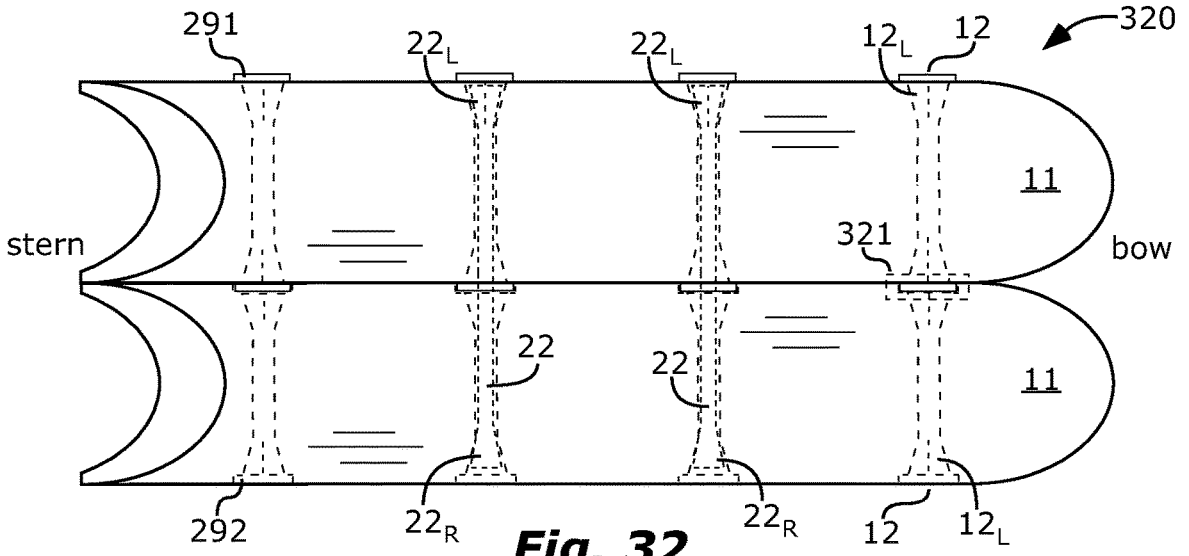

FIG. 32 is a top-view of a modular boat with two sections 11 and multiple pairs of holes 12. Each pair includes a hole 12 from each of the two sections 11 aligned with each other and joined together at a junction 321. Each junction 321 includes a protrusion 291 surrounding an end of one of the holes 12 inserted into and mating with a cavity 292 surrounding an end of the other hole 12. A rod 22 extends through two middle pairs of holes 12.

Figure 33:
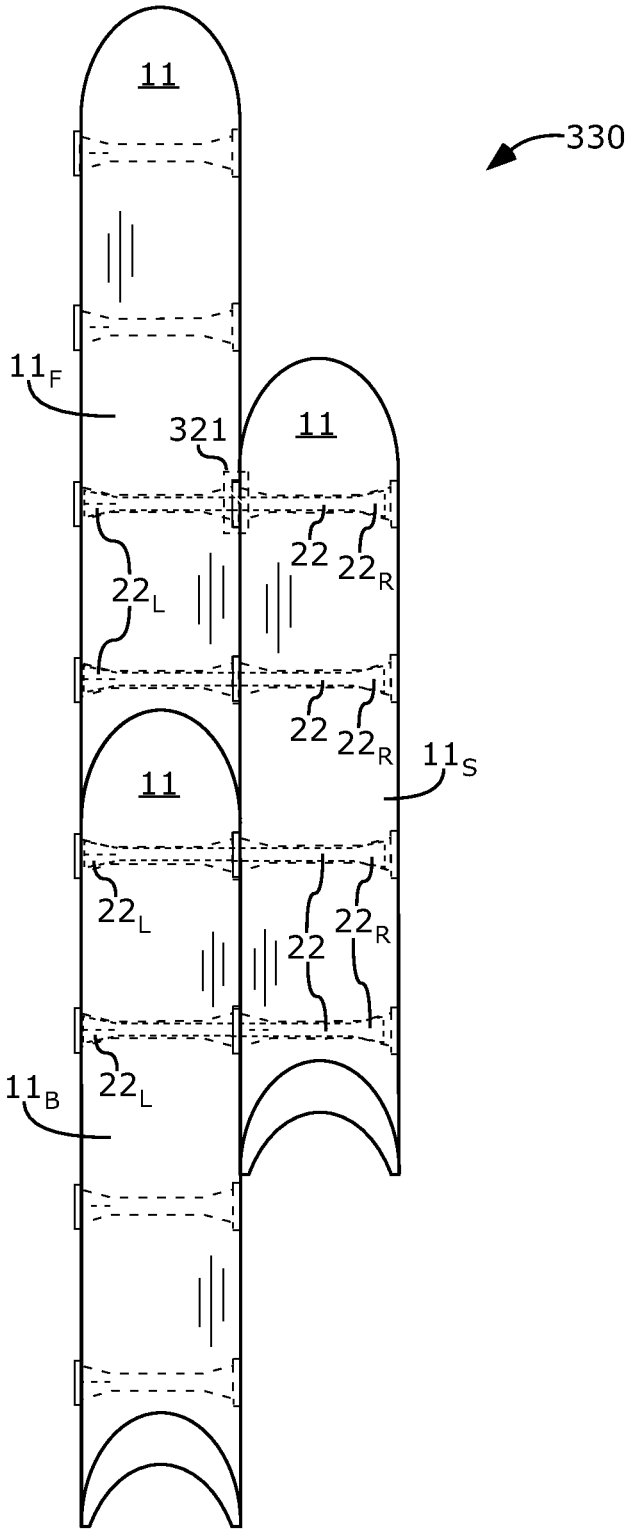

FIG. 33 is a top-view of a modular boat 330 with a front section $11_F$, a back section $11_B$, and a side section $11_S$. A convex shape of the bow of the back section $11_B$ matches and mates with a concave shape of the stern of the front section $11_F$. The side section $11_S$ adjoins a side of the back section $11_B$ and a side of the front section $11_F$. There are four rods 22. Two rods 22 extend through two holes 12 of the front section $11_F$ and the side section $11_S$. Two rods 22 extend through two holes 12 of the back section $11_B$ and the side section $11_S$.

Figure 34:
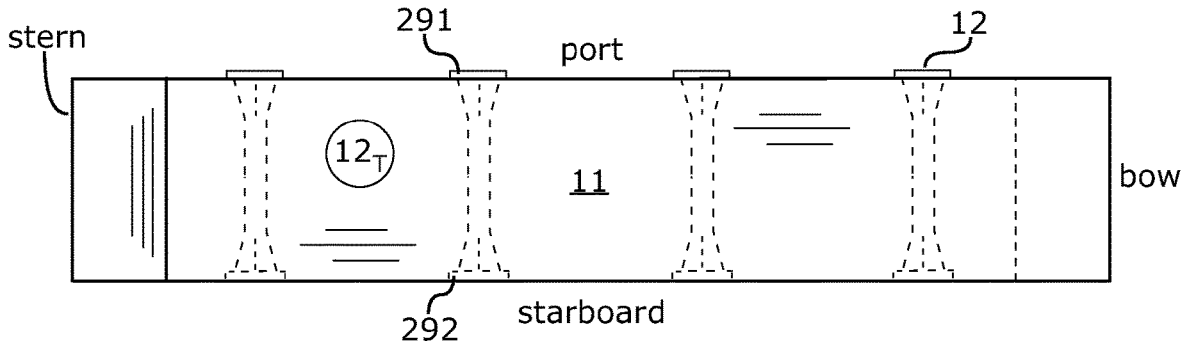

FIG. 34 is a top-view of a modular boat section 11 with (a) multiple holes 12 extending between port and starboard; (b) a bow sloping from top $12_T$ to bottom $12_B$ (see FIGS. 35-36 and 39), lengthening the section 11 at the top $12_T$ and shortening the section 11 at the bottom $12_B$; and (c) a stern sloping from a bottom $12_B$ to a top $12_T$, lengthening the section 11 at the bottom $12_B$ and shortening the section 11 at the top $12_T$.

Figure 35:
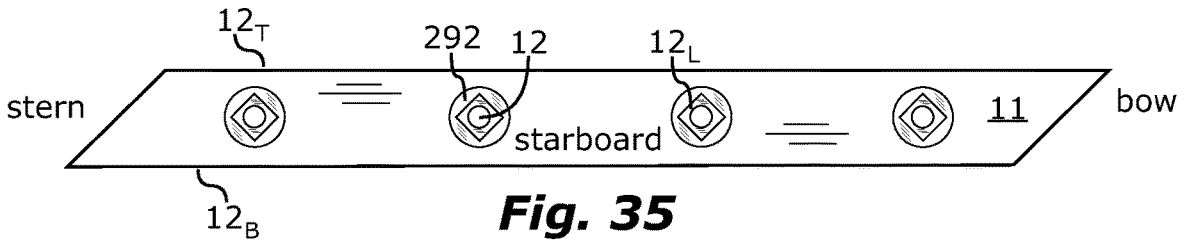

FIG. 35 is a starboard side-view of the modular boat section 11 of FIG. 34.

Figure 36:
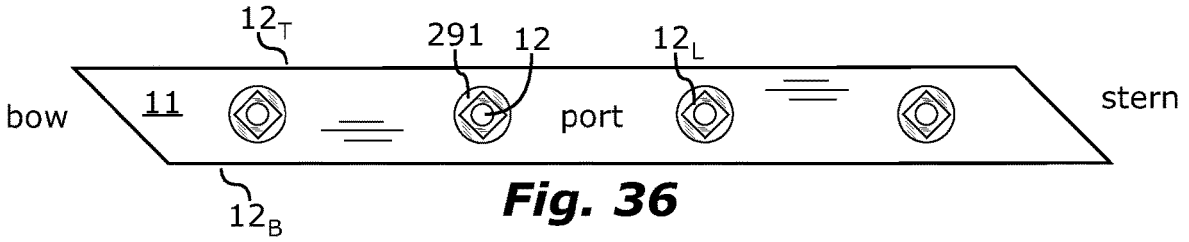

FIG. 36 is a port side-view of the modular boat section 11 of FIG. 34.

Figure 37:
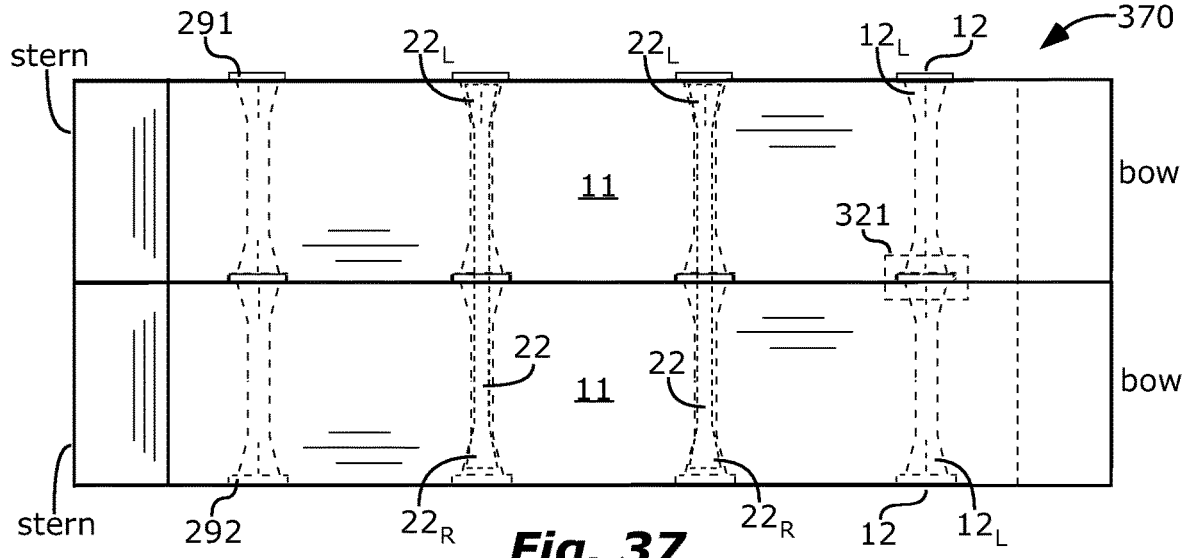

FIG. 37 is a top-view of a modular boat, with two sections 11 like those in FIGS. 34-36, and with multiple pairs of holes 12. Each pair includes a hole 12 from each of the two sections 11 aligned with each other and joined together at a junction 321. Each junction 321 includes a protrusion 291 surrounding an end of one of the holes 12 inserted into and mating with a cavity 292 surrounding an end of the other hole 12. There are two rods 22, each extending through one of the middle pairs of holes 12.

Figure 38:
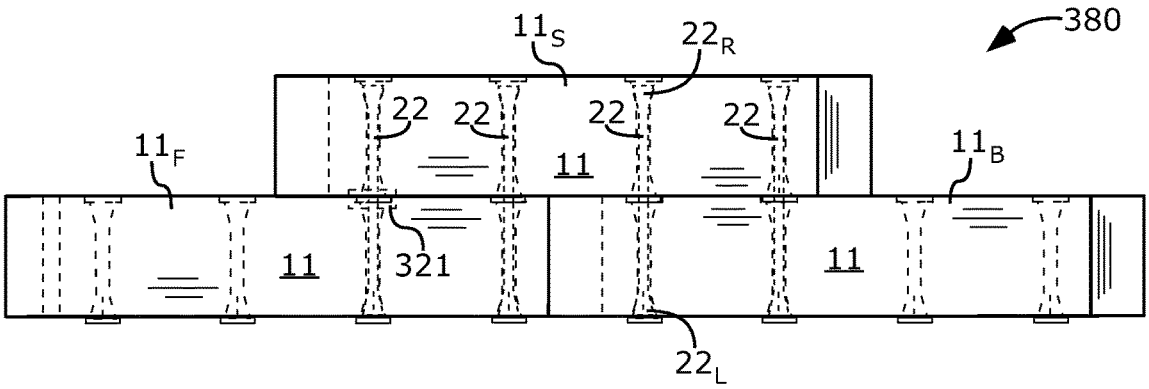

FIG. 38 is a top-view of a modular boat 330 with a front section $11_F$, a back section $11_B$, and a side section $11_S$. A sloping bow of the back section $11_B$ can match and mate with a sloping stern of the front section $11_F$. The side section $11_S$ can adjoin the back section $11_B$ and the front section $11_F$. There are four rods 22. Two rods 22 extend through two holes 12 of the front section $11_F$ and the side section $11_S$. Two rods 22 extend through two holes 12 of the back section $11_B$ and the side section $11_S$.

Figure 39:
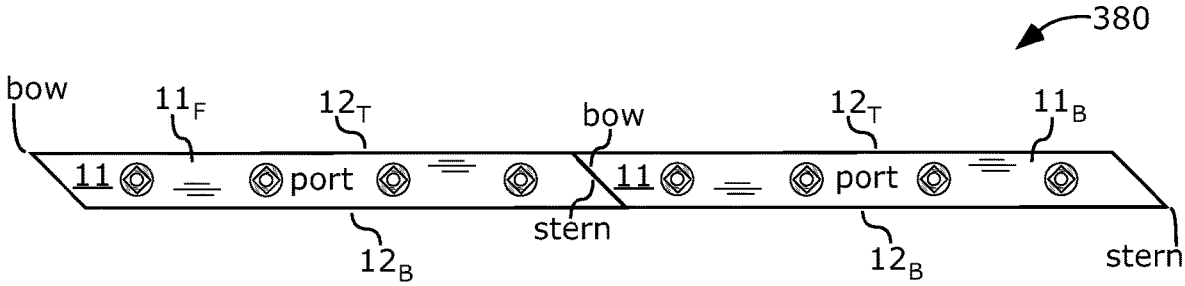

FIG. 39 is a port side-view of the modular boat section 11 of FIG. 38.

Figure 40:
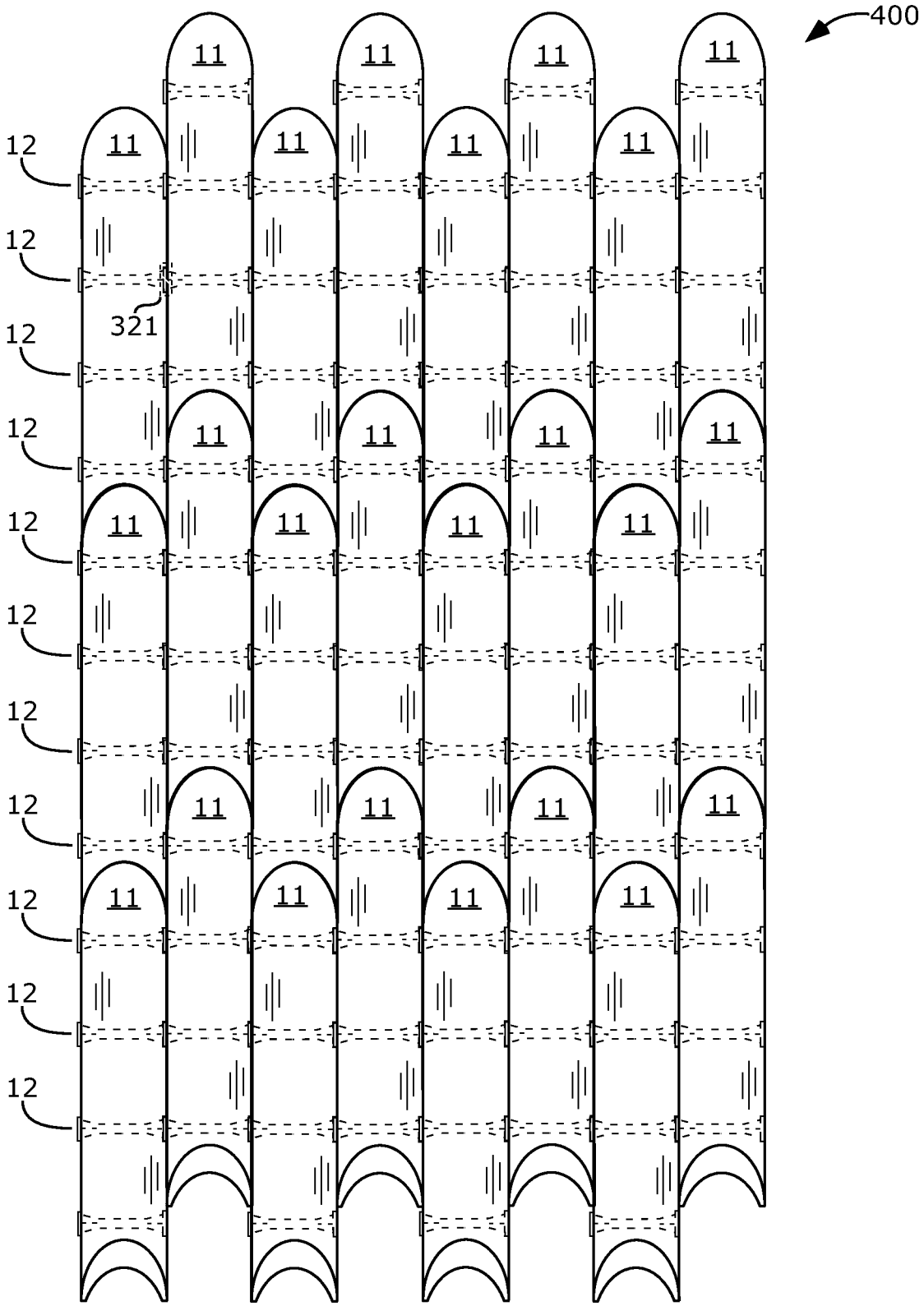

FIG. 40 is a flotation device 340 with many sections 11, some joined side by side, and some joined bow to stern. A rod 22 (not shown) can extend through each group of holes 12.

Definitions

The following definitions, including plurals of the same, apply throughout this patent application.

The terms "located directly on", "adjoin", "adjoins", and "adjoining" mean direct and immediate contact.

As used herein, the term "cm" means centimeter(s), the term "m" means meter(s), and the term "mm" means millimeter(s).

As used herein, the term "equal", such as "equal widths" or "equal spacing", means exactly equal, equal within normal manufacturing tolerances, or nearly equal, such that any deviation from exactly equal would have negligible effect for ordinary use of the device.

As used herein, the term "identical", means exactly identical, identical within normal manufacturing tolerances, or nearly identical, such that any deviation from exactly identical would have negligible effect for ordinary use of the device.

As used herein, the term "parallel" means exactly parallel, or substantially parallel, such that planes or vectors associated with the devices in parallel would intersect with an angle of ≤25°. Intersection of such planes or vectors can be ≤5°, ≤10°, or ≤20° if explicitly so stated.

As used herein, the term "perpendicular", means exactly perpendicular, perpendicular within normal manufacturing tolerances, or nearly perpendicular, such that any deviation from exactly perpendicular would have negligible effect for ordinary use of the device.

As used herein, the term "rectangular shape", means exactly rectangular, rectangular within normal manufacturing tolerances, or nearly rectangular, such that any deviation from exactly rectangular would have negligible effect for ordinary use of the device.

DETAILED DESCRIPTION

Figure 1:
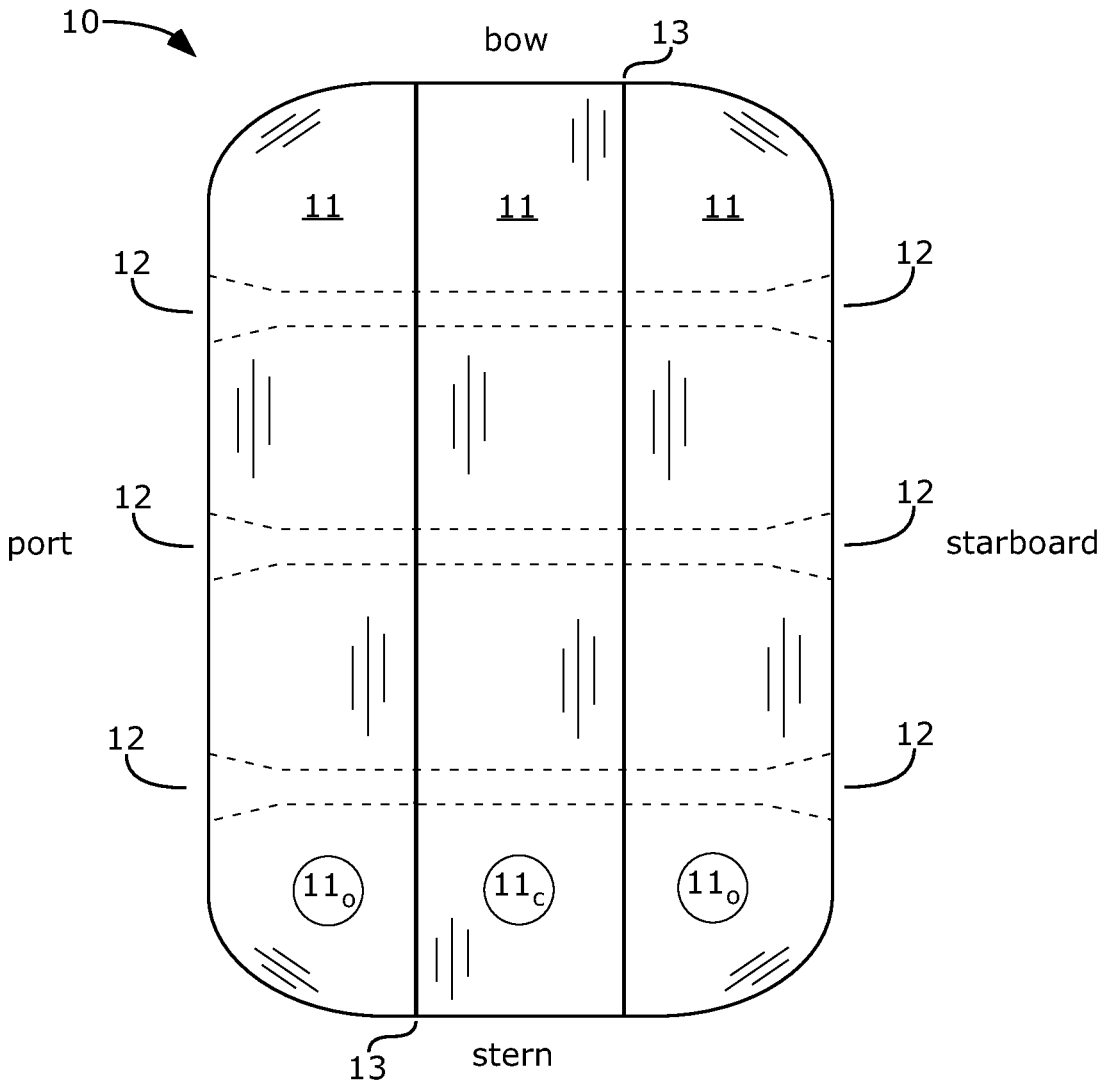

As illustrated in FIG. 1, a modular boat 10 can include multiple sections 11, including a center-section $\mathbf{11}_c$ between the two outer-sections $\mathbf{11}_o$. The two outer-sections $\mathbf{11}_o$ can be located at port and starboard sides of the modular boat.

Multiple holes 12 can extend through the multiple sections 11. Each hole 12 can extend in a straight line between port and starboard through all of the sections 11.

One hole 12 might be sufficient, especially if combined with the interlock-connections 141 or protrusion 291 and cavity 292 described below. At least three holes 12 is preferred. Each section 12 can be joined to the other sections 11 to form and use the modular boat 10, and can be separated from the other sections 11 for easier transportation. Each section 12 can extend from bow to stern and can be joined to at least one other section 12 at a junction 13 extending from bow to stern.

Figure 2:
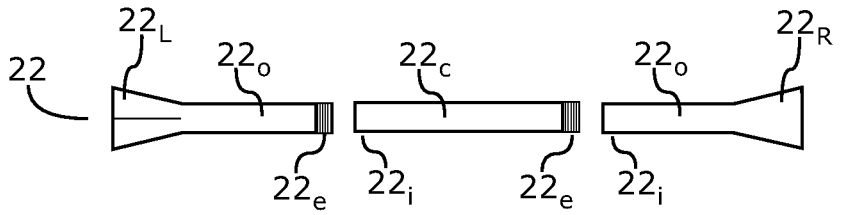

A disassembled rod 22, for coupling the multiple sections 11, is illustrated in FIG. 2. Each section of the rod 22 can be associated with a section 11 of the modular boat 10. For example, the modular boat 10 includes a center-section $\mathbf{11}_c$ between the two outer-sections $\mathbf{11}_o$ and the rod can include a center-rod $\mathbf{22}_c$ between two outer rods $\mathbf{22}_o$.

One outer rod $\mathbf{22}_0$ can include external threads $\mathbf{22}_e$ and the other outer rod $\mathbf{22}_0$ can include internal threads $\mathbf{22}_i$ to allow the two outer rods $\mathbf{22}_0$ to be coupled together if only two sections 11 of the modular boat 10 are used. The center-rod (s) $\mathbf{22}_c$ can include an external thread $\mathbf{22}_c$ at one end and an internal thread $\mathbf{22}_i$ at an opposite end. The rod 22 can shorten its length, such as by threading the sections of the rod together, pulling the outer rods $\mathbf{22}_o$ towards each other.

The rod 22 can include a locking-rod-end $\mathbf{22}_L$ with multiple sides, such as for example at least three sides (but can have more sides, such as for example four, five, or six sides). The locking-rod-end $\mathbf{22}_L$ can mate with a similarly-shaped cavity in the modular boat 10, which can prevent this end of the rod 22 from spinning while an opposite end spins to tighten the modular boat together. An opposite end of the rod can be a round-rod-end $\mathbf{22}_R$, capable of spinning in a cavity at an opposite end of the modular boat 10.

The hole 12 can include a locking-hole-end $\mathbf{12}_L$ (see FIGS. 8-11) with multiple sides capable of mating with the multiple sides of the locking-rod-end $\mathbf{22}_L$ of the rod 22, holding the locking-rod-end $\mathbf{22}_L$ of the rod 22 in place while the round-rod-end $\mathbf{22}_R$ rotates. One end of the hole 12 can be a locking-hole-end $\mathbf{12}_L$ and the opposite end can be round, to allow easier rotation of the round-rod-end $\mathbf{22}_R$. Alternatively, both ends of the hole 12 can be locking-hole-ends $\mathbf{12}_L$ so the user can insert the rod 22 either direction—and the round-rod-end $\mathbf{22}_R$ can rotate even in the locking-hole-end $\mathbf{12}_L$.

Rotating the round-rod-end $\mathbf{22}_R$ in one direction (e.g. clockwise) can shorten the length of the rod 22, pulling the locking-rod-end $\mathbf{22}_L$ and the round-rod-end $\mathbf{22}_R$ towards each other, and pulling the multiple sections 11 of the modular boat together. Rotating the round-rod-end $\mathbf{22}_R$ in an opposite direction (e.g. counterclockwise) can increase the length of the rod, pushing the locking-rod-end $\mathbf{22}_L$ and the round-rod-end $\mathbf{22}_R$ away from each other, releasing the multiple sections 11 of the modular boat from each other. Thus, as the sections of the rod 22 are threaded together, by rotating the round-rod-end $\mathbf{22}_R$ while the locking-rod-end $\mathbf{22}_L$ is held in place, the two outer rods $\mathbf{22}_o$ can be drawn towards each other, and pressing the multiple sections 11 of the modular boat together.

Figure 3:
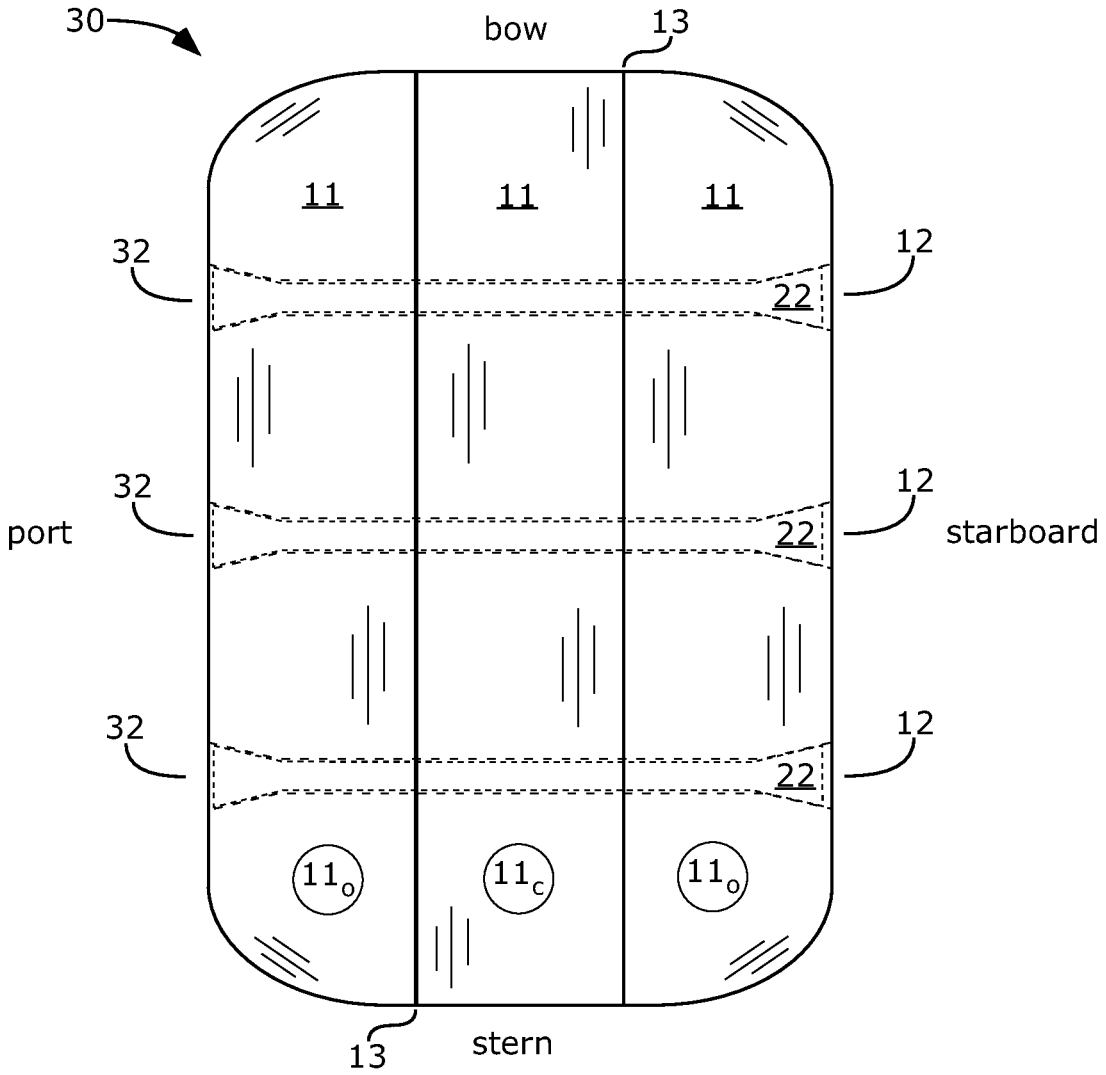
Figure 4:
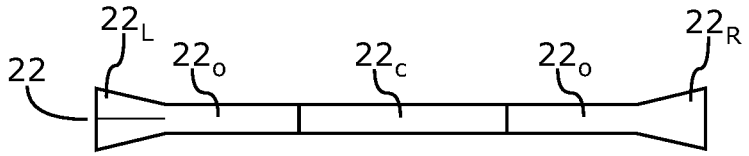

The rods 22 in the holes 12 of a modular boat 30, forming rod-connections 32, are illustrated in FIG. 3. The holes 12 and the rod-connections 32 can extend perpendicular to the junction 12, through the multiple sections 11 across the modular boat 30 from one side of the modular boat 30 to an opposite side of the modular boat 30. An assembled rod 22, as it could look within the modular boat 30, is illustrated in FIG. 4. The rod 22 can be removable, such as for example by unthreading, to allow separation of the sections 11. Separation of the sections 11 can allow easy transport of the sections 11 of the modular boat 30.

Figure 5:
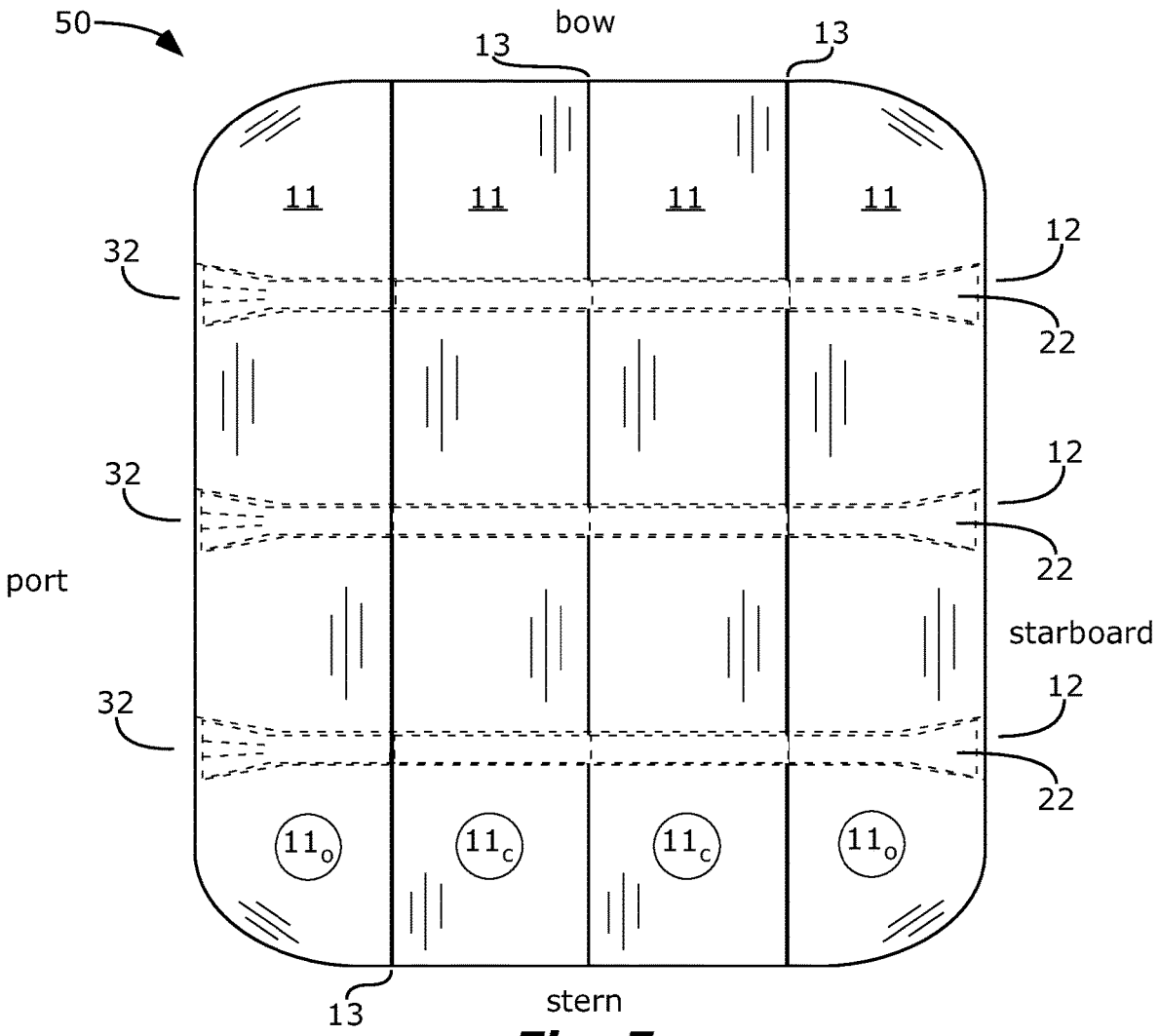
Figure 6:
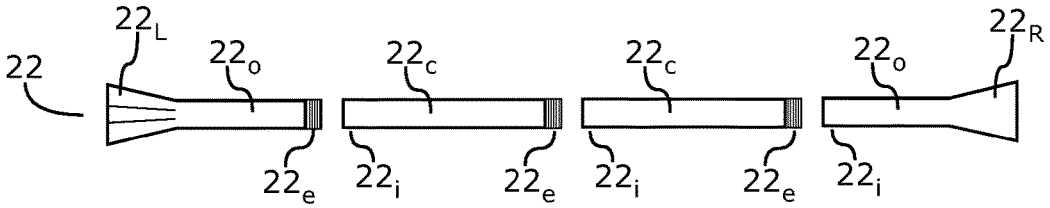
FIG. 6 shows sections of a rod 22 capable of being joined together to form a rod-connection 32 (see FIG. 5).
Figure 7:
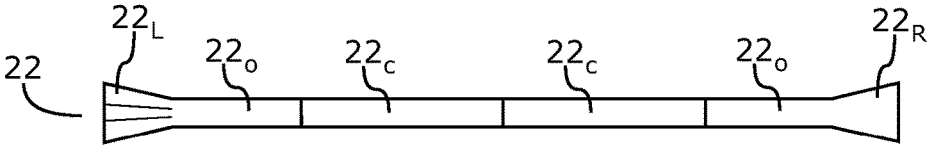
FIG. 7 shows sections of a rod 22 assembled together as it would be in the rod-connection 32 of FIG. 5.

As illustrated in FIG. 5, the modular boat 50 can include multiple center-sections $\mathbf{11}_c$ between the two outer-sections $\mathbf{11}_o$. There can be more than the two center-sections $\mathbf{11}_c$ illustrated in FIG. 5. By adding more center-sections $\mathbf{11}_c$, the modular boat 50 can be used as a raft or platform. An unassembled rod 22 for four boat sections 11 is illustrated in FIG. 6. An assembled rod 22 for four boat sections 11 is illustrated in FIG. 7.

The outer-sections $\mathbf{11}_o$ at port and starboard sides of the modular boat are shown in FIGS. 8-11. A locking-hole-end $\mathbf{12}_L$ at both opposite ends of the hole 12 is illustrated in FIGS. 8-9. The locking-rod-end $\mathbf{22}_L$ in a locking-hole-end $\mathbf{12}_L$, at the port side of the modular boat 100, is illustrated in FIG. 10. Alternatively, the round-rod-end $\mathbf{22}_R$ could be used at the port side. The round-rod-end $\mathbf{22}_R$ in a locking-hole-end $\mathbf{12}_L$, at the starboard side of the modular boat 110, is illustrated in FIG. 11. Alternatively, the locking-rod-end $\mathbf{22}_L$ could be used at the starboard side.

As illustrated in FIG. 11, the round-rod-end $\mathbf{22}_R$ can include a socket 22*s*, such as for example a Philipps, star head, or hexagonal socket, allowing the round-rod-end $\mathbf{22}_R$ to be turned by a Philipps screwdriver, star-shaped bit, or a hex wrench. The bit can be inserted into a portable drill, allowing rapid rotation of the round-rod-end $\mathbf{22}_R$ and quick assembly of the modular boat. The portable drill can rotate the round-rod-end $\mathbf{22}_R$ to shorten the rod 22 by rotation in one direction and can lengthen the rod 22 by rotation in the opposite direction.

As illustrated in FIG. 12, the modular boat 120 can have a kayak-configuration. As illustrated in FIG. 13, the modular boat 130 can have a catamaran-configuration. Following is a description of how the same multiple sections 11 can be arranged in either configuration. The multiple sections 11 can include two outer-sections $\mathbf{11}_o$ located at port and starboard sides of the modular boat 120 or 130. Each of the multiple sections 11 can include an inner-side $\mathbf{11}_{is}$ and an outer-side $\mathbf{11}_{os}$, opposite of each other, and two opposite edges $\mathbf{11}_E$ extending between the inner-side $\mathbf{11}_{is}$ and the outer-side $\mathbf{11}_{os}$.

Each outer-section $\mathbf{11}_o$ can have a hole extending through the outer-section $\mathbf{11}_o$ from one edge $\mathbf{11}_E$ to the opposite edge $\mathbf{11}_E$, defining a kayak-hole $\mathbf{12}_K$. The modular boat can have a kayak-configuration when the kayak-hole $\mathbf{12}_K$ of each outer-section $\mathbf{11}_o$ is aligned with the center-section $\mathbf{11}_c$ hole 12. The rod 22 can extend through the kayak-holes $\mathbf{12}_K$ and the hole 12 through the center-section $\mathbf{11}_c$.

Each outer-section $11_o$ can have a hole extending through the outer-section $11_o$ from the inner-side $11_{is}$ to the outer-side $11_{os}$, defining a catamaran-hole $12_C$. The modular boat can have a catamaran-configuration when (a) the outer-sections $11_o$ are rotated 90 degrees with the inner-side $11_{is}$ facing each other, along an axis parallel to the junction, compared to the kayak-configuration, (b) the catamaran-hole $12_C$ of each outer-section $11_o$ is aligned with the hole 12 through the center-section $11_c$, and (c) the rod 22 extends through the catamaran-hole $12_C$ and through the center-section $11_c$ hole 12. The kayak-holes $12_K$ can be offset from the catamaran-holes $12_C$, such that the kayak-holes $12_K$ don't intersect with the catamaran-holes $12_C$.

Illustrated in FIGS. 12-13 are example relative dimensions of the outer-sections $11_o$: $1.2*W_{IO} \leq W_E$, $2*W_{IO} \leq W_E$, or $4*W_{IO} \leq W_E$; and $W_E \leq 4*W_{IO}$, $W_E \leq 10*W_{IO}$, or $W_E \leq 20*W_{IO}$. $W_E$ is a widest width between the two opposite edges $11_E$. $W_{IO}$ is a widest width between the inner-side $11_{is}$ and the outer-side $11_{os}$. These relative dimensions can apply to all embodiments herein.

As illustrated in FIGS. 1-7, 12-13, and 25, the hole 12 and the rod 22 can have a taper at one or both ends, to improve holding the sections 11 together. The locking-rod-end $22_L$ of the rod 22 can have a larger diameter at an outermost-end and tapering to a smaller diameter farther from the outermost-end (nearer a center) of the rod 22. The locking-hole-end $12_L$ can have taper to mate with the tapering of the locking-rod-end $22_L$ of the rod. The round-rod-end $22_R$ of the rod 22 can have a larger diameter at an outermost-end and tapering to a smaller diameter farther from the outermost-end (nearer a center) of the rod 22. A cavity in the hole encircling the round-rod-end $22_R$ (which can also be a locking-hole-end $12_L$) can have a taper to mate with the tapering of the round-rod-end $22_R$ of the rod.

As illustrated in FIGS. 14-16, a modular boat 140 is shown comprising multiple sections 11. In FIG. 14, the multiple sections 11 are separated for easier transportation. In FIGS. 15-16, the multiple sections 11 are joined together by interlock-connections 141.

Each interlock-connection 141 can include a key $141_k$ inserted into a slot $141_s$ of an adjacent section at the junction 13. Thus, each section 12 can be joined to the other sections 11 to form and use the modular boat 140, and can be separated from the other sections 11 for easier transportation. Each section 12 can extend from bow to stern and can be joined to at least one other section 12 at a junction 13 extending from bow to stern.

Modular boat 140 in FIGS. 14-15 includes two outer-sections $11_o$, at port and starboard sides, and a center-section $11_c$ between the two outer-sections $11_o$. There can be more than one center-section $11_c$ between the two outer-sections $11_o$, like modular boat 50, but with interlock-connections 141 instead of or in addition to the rod-connections 32. Each of the multiple sections 11 can include an array of keys $141_k$ or an array of slots $141_s$ along a majority of a length of the section 11, the length extending from the bow to the stern. One of the two outer-sections $11_o$ (port side of modular boat 140) can include an array of keys $141_k$ and the other of the two outer-sections $11_o$ (starboard side of modular boat 140) can include an array of slots $141_s$. The center-section $11_c$ of modular boat 140 includes an array of slots $141_s$ on one edge (adjacent to the port side) and an array of keys $141_k$ on an opposite edge (adjacent to the starboard side). Each key $141_k$ of one of the edges $11_E$ on the center-section can be aligned with one of the slots $141_s$ on the opposite edge $11_E$. Alternatively, there can be both keys $141_k$ and slots $141_s$ on each section 11.

The keys $141_k$ and slots $141_s$ can have the shape described in this paragraph, and illustrated on modular boat 140, for stronger interlock-connections 141. Each key $141_k$ can include a narrow-region $141_{kn}$ proximal to the section 11 it emanates from, and each slot $141_s$ can include a narrow-channel $141_{sn}$ farther from the section 11 it emanates from. The narrow-region can mate with the narrow-channel $141_{sb}$. Each key $141_k$ can include a wide-region $141_{kw}$ farther from the section 11 it emanates from, and each slot $141_s$ can include a wide-channel $141_{sw}$ proximal to the section 11 it emanates from. The wide-region $141_{kw}$ can mate with the wide-channel $141_{sw}$.

As illustrated in FIG. 16, modular boat 160 is similar to modular boat 140 except that modular boat 160 lacks a center-section $11_c$. The two outer-sections $11_o$ of modular boat 160 directly adjoin each other by interlock-connections 141. Also illustrated in FIG. 16 is a tab 161 capable of swinging to lock the key $141_k$ in the slot $141_s$ and to prevent accidental removal of the key $141_k$. The tab 161 is applicable to any interlock-connection 141 embodiments described herein.

Illustrated in FIG. 17 is a side-view of an outer-section $11_o$, showing an array of slots $141_s$, like the starboard side of modular boat 140. Illustrated in FIG. 18 is a side-view of an outer-section $11_o$, showing an array of keys $141_k$, like the port side of modular boat 140. Some keys $141_k$, or the array of keys $141_k$, can be located at the starboard side; and some slots $141_s$, or the array of slots $141_s$, can be located at the port side. Thus, the location of keys $141_k$ and slots $141_s$ (port or starboard) in the figures is merely an example.

As illustrated in FIGS. 14, 17-18, and 23-24, each of the multiple sections 11 can include an inner-side $11_{is}$ and an outer-side $11_{os}$, opposite of each other, and two opposite edges $11_E$ extending between the inner-side $11_{is}$ and the outer-side $11_{os}$. As illustrated in FIGS. 17-18, each interlock-connection 141, each key $141_k$ or slot $141_s$, on the edge $11_E$ at the inner-side $11_{is}$ can extend part-way from the inner-side $11_{is}$ towards the outer-side $11_{os}$, leaving a strip 171 extending from the opposite edge $11_E$ at the outer-side $11_{os}$ without the interlock-connection 141.

As illustrated in FIGS. 19 and 21, each slot $141_s$ can have a taper, with a larger width ($W_{S1}$, $W_{S3}$, or both) at an entry-region $141_{se}$ of the slot 141, and tapering down to a smaller width ($W_{S2}$, $W_{S4}$, or both) farther from the entry-region $141_{se}$. As illustrated in FIGS. 20 and 22, each key $141_k$ can have a taper, matching the taper of the slot, with a smaller width ($W_{K2}$, $W_{K4}$, or both) of the key $141_k$ mating with the smaller width ($W_{S2}$, $W_{S4}$, or both) of the slot $141_s$ and a larger width ($W_{K1}$, $W_{K3}$, or both) of the key $141_k$ mating with the larger width ($W_{S1}$, $W_{S3}$, or both) of the slot $141_s$.

As illustrated in FIGS. 19 and 20, the taper of the slot $141_s$ can be in the wide-channel $141_{sw}$ and the taper of the key $141_k$ can be in the wide-region $141_{kw}$. As illustrated in FIGS. 21 and 22, the taper of the slot $141_s$ can be also or alternatively in the narrow-channel $141_{sn}$ and the taper of the key $141_k$ can be also or alternatively in the narrow-region $141_{kn}$. This taper can assist in firmly seating the key $141_k$ in the slot $141_s$.

As illustrated in FIGS. 23 and 24, the keys $141_k$ and the slots $141_s$ on the center-section $11_c$ for the interlock-connections 141 can be on the two opposite edges $11_E$ of the center-section $11_c$. Each outer-section $11_o$ can include key(s) $141_k$, slot(s) $141_s$, or both, for the interlock-connection(s) 141, on the inner-side $11_{is}$ and on one of the two opposite edges $11_E$, defining an inner-edge $11_{IE}$.

Modular boat 230 has a kayak-configuration (FIG. 23) with each inner-edge $\mathbf{11}_{IE}$ forming part of the interlock-connection 141. Modular boat 240 has a catamaran-configuration (FIG. 24) with (a) the outer-sections $\mathbf{11}_o$ rotated 90 degrees with the inner-sides $\mathbf{11}_{is}$ facing each other, along an axis parallel to the junction, compared to the kayak-configuration, and (b) each inner-side $\mathbf{11}_{is}$ forms part of the interlock-connection 141. Usually port and starboard sides swap locations in changing between the kayak-configuration (FIG. 23) and the catamaran-configuration (FIG. 24).

As illustrated in FIG. 25, modular boat 250 comprises multiple sections 11 joined together by rod-connection(s) 32 and by interlock-connection(s) 141. Each section 12 can be physically separable from the other sections 11. Each section 12 can extend from bow to stern and can be joined to at least one other section 12 at a junction 13 extending from bow to stern. The rod-connection(s) and the interlock-connection(s) 141 can have a configuration as described above. Thus, the rod-connection(s) 32, the interlock-connection(s) 141, or both can be used with any example modular boat herein.

The multiple sections 11 in any of the modular boat embodiments described herein can be made of plastic with a hollow core or a foam-filled core. The holes 12 can be formed as a plastic cylinder. The holes 12 can be formed by drilling, or formed during molding.

Illustrated in FIG. 26 is a plate 261 for a removable roof rack. Illustrated in FIGS. 27-28 is a removable roof rack 270 including two separate plates 261. Each plate 261 can have two sides opposite of each other, including an inner-face 272 and an outer-face 273. The inner-faces 272 of the plates 261 can face each other.

Each plate 261 can have an edge-perimeter at an outer face and between the inner-face 272 and the outer-face 273. The edge-perimeter can include (a) a bottom-edge 266 facing down, (b) a top-edge 267 facing up, and (c) two end-edges 268 at opposite ends of the plate 261 between and linking the bottom-edge 266 and the top-edge 267.

Multiple bars 271 can be removably-attached to the plates 261, between the plates 261, to connect the plates 261 to each other. Each plate 261 can be attached to each bar 271 by a screw through an edge-hole 262 in the plate 261, and into the bar 271.

A series of edge-holes 262, proximate the edge-perimeter, can provide locations for mounting the bars 271. For example, there can be a series of edge-holes 262 proximate to one or more of the following locations: (a) one or both of the two end-edges 268, (b) the bottom-edge 266, and (c) the top-edge 267. The edge-holes 262 can be sized and spaced for the multiple bars 271 to be removably-attached to each plate 261 and to connect the plates 261 to each other. Each series of edge-holes 262 can have equal spacing between adjacent edge-holes 262. Example spacing can be a number between 15 mm and 100 mm. There can be ≥2, ≥4, ≥8, or ≥20 edge-holes 262.

A width W of the sides 272 and 273 can be perpendicular to the ground. A length L of the sides 272 and 273 can be parallel to the ground. The width W and the length L can be perpendicular with respect to each other. A thickness Th of the sides 272 and 273, between the inner-face 272 and the outer-face 273, can be parallel to the ground. The thickness Th can be perpendicular to the width W and the length L.

The length L can be greater than the width W. The width w can be greater than the thickness Th. For example, 10≤W/Th, 15≤W/Th, 50≤W/Th, W/Th≤250, W/Th≤1000, 15≤L/Th, 25≤L/Th, 50≤L/Th, 200≤L/Th, L/Th≤300, L/Th≤1000, L/Th≤5000. Example sizes of the length L, width W, and thickness Th include: 1 mm≤Th≤25 mm, 20 cm≤W≤1 m, 1 m≤L≤4 m.

Each plate 261 can include one or more series $S_1$, $S_2$, $S_3$ of rod-holes 26. Each series $S_1$, $S_2$, $S_3$ can be parallel to the ground. The series $S_1$, $S_2$, $S_3$ of rod-holes 26 of the separate plates 261 can be aligned with respect each other. The rod-holes 265 can be spaced and sized for holding equipment on the rack. For example, 15 mm≤D≤65 mm, where $D_{265}$ is a diameter of the rod-holes 265. As illustrated in FIG. 27, rods 22 can extend through the rod-holes 265 of the plates 261 and through the catamaran-holes $\mathbf{12}_C$ in the sections 11 of the boat, to hold the boat on the rack. As illustrated in FIG. 28, rods 22 can extend through the rod-holes 265 of the plates 261 and through the kayak-holes $\mathbf{12}_K$ in the sections 11 of the boat, to hold the boat on the rack.

Each plate 261 can include a series of hand-holes 263 proximate to the top-edge 267, for carrying the plates 261. An example size of the hand-holes is ≥75 mm.

Each plate 261 can include a series of mounting-holes 264 proximate to the bottom-edge 266. The mounting-holes 264 can be used to mount the removable roof rack 270 to a permanent roof rack on the car, such as with a U-bolt or other roof rack bracket. An example size of the mounting-holes 264 is at least 25 mm across.

As illustrated in FIGS. 29-31 and 34-36, a modular boat section 11 can include a bow, a stern, a port, and a starboard. The single section 11 can be used as a flotation device or a paddleboard.

The section 11 can include multiple holes 12 extending between port and starboard. For example, the section can include ≥1, ≥2, or ≥3 holes 12 and ≤3, ≤6, ≤10, or ≤25 holes 12.

Each hole 12 can have a protrusion 291 at one end. The protrusion 291 can surround this end of the hole 12. Each hole 12 can have a cavity 292 at an opposite end of the hole 12. The cavity 292 can surround the opposite end of the hole 12. The protrusion 291 can be sized to fit inside of the cavity 292 so that the protrusion 291 of the section 11 can mate with the cavity 292 of an identical section 11 (see FIGS. 33 and 37-39).

As illustrated in FIG. 32, one section 11 can have protrusions 291 at both ends of its hole(s) 12. This section 11 can mate with another section 11 that has cavities 292 at both ends of its hole(s) 12.

As illustrated in FIGS. 29-33 and 40, the bow of the section 11 can have a convex shape and the stern can have a concave shape. The convex shape can match the concave shape so that (a) the bow of the section 11 can mate with the stern of another section, which can be an identical section 11, and (b) the stern of the section 11 can mate with the bow of another section, which can be an identical section 11.

As illustrated in FIGS. 34-37, the bow can slope from top $\mathbf{12}_T$ to bottom $\mathbf{12}_B$, lengthening the section 11 at the top $\mathbf{12}_T$ and shortening the section 11 at the bottom $\mathbf{12}_B$. The stern can slope from a bottom $\mathbf{12}_B$ to a top $\mathbf{12}_T$, lengthening the section 11 at the bottom $\mathbf{12}_B$ and shortening the section 11 at the top $\mathbf{12}_T$. The top $\mathbf{12}_T$ of the section 11 can be identical in shape to the bottom of the section 11. The top $\mathbf{12}_T$ of the section 11 and the bottom of the section can have a rectangular shape, offset longitudinally with respect to each other.

As illustrated in FIGS. 38-39, the slope at the bow can match the slope at the stern so that (a) the bow of the section 11 can mate with the stern of another section, which can be an identical section 11, and (b) the stern of the section 11 can mate with the bow of another section, which can be an identical section 11.

As illustrated in FIGS. 32-33 and 37-40, a modular boat can include two sections 11. The sections 11 can be identical. Each section 11 can include a bow, a stern, a port, and a starboard. A port of one of the sections 11 can be adjacent to or can adjoin the starboard of the other section 11.

The two sections 11 can include multiple pairs of holes 12. Each pair can include a hole 12 from each of the two sections 11 aligned with each other. Each hole 12 can extend between port and starboard of the section 11 it is in.

The pair of holes 12 can join together at a junction 321. Each junction 321 can include the protrusion 291 inserted into and mating with a cavity 292 of the other hole 12.

A rod 22 can extend through each of the pairs of holes 12. Each rod 22 can be removable to allow separation of the sections 11. The rod 22 and the holes 12 can have characteristics as described above.

Each rod 22 can have a locking-rod-end $\mathbf{22}_L$ including ≥three sides, ≥four sides, ≥five sides, or ≥six sides. The rod 22 can shorten its length, as described above, pulling the locking-rod-end $\mathbf{22}_L$ and an opposite end towards each other, and pressing the two sections 11 of the modular boat together. The rod 22 can shorten its length by rotating the opposite end. The opposite end of each rod 22 can be a round-rod-end $\mathbf{22}_R$.

Rods 22 extend through the two middle pairs of holes in FIGS. 32 and 37, and through the four pairs of holes in FIGS. 33 and 38. The rods 22 are not shown in FIG. 40, but a rod 22, which eight parts, can extend through all eight sections 11.

Each hole 12 can have a locking-hole-end $\mathbf{12}_L$ including ≥three sides, ≥four sides, ≥five sides, or ≥six sides, which can match or mate with the sides of the locking-rod-end $\mathbf{22}_L$ and hold the locking-rod-end $\mathbf{22}_L$ of the rod 22 in place while the opposite end rotates. Both ends of each hole 12 can be locking-hole-ends $\mathbf{12}_L$.

As illustrated in FIG. 33, modular boat 330 can include a front section $\mathbf{11}_F$, a back section $\mathbf{11}_B$, and a side section $\mathbf{11}_S$. The bow of the back section $\mathbf{11}_B$ can have a convex shape. The stern of the front section $\mathbf{11}_F$ can have a concave shape. The convex shape can match the concave shape. As illustrated in FIG. 38, modular boat 380 can include a front section $\mathbf{11}_F$, a back section $\mathbf{11}_B$, and a side section $\mathbf{11}_S$. A sloping bow of the back section $\mathbf{11}_B$ can match and mate with a sloping stern of the front section $\mathbf{11}_F$.

Thus, in modular boats 330 and 380, the bow of the back section $\mathbf{11}_B$ can adjoin and mate with the stern of the front section $\mathbf{11}_F$, the back section $\mathbf{11}_B$ and the front section $\mathbf{11}_F$ forming a longitudinal pair. The side section $\mathbf{11}_S$ can adjoin both sections $\mathbf{11}_F$ and $\mathbf{11}_B$ of the longitudinal pair. The back section $\mathbf{11}_B$, the front section $\mathbf{11}_F$, and the side section 11 can be identical.

One of the rods 22 can extend through a pair of holes 12 of the front section $\mathbf{11}_F$ and the side section $\mathbf{11}_S$. Another of the rods 22 can extend through holes 12 of the back section $\mathbf{11}_B$ and the side section $\mathbf{11}_S$.

As illustrated in FIG. 40, a flotation device 400 can include many sections 11, some joined side by side, and some joined bow to stern. A rod 22 (not shown) can extend through each group of holes 12, through all sections aligned with each hole. In FIG. 40, most holes 12 extend through eight sections. The flotation device 340 can be a modular boat, a dock, a raft, or a bridge. Sections 11 like the section 11 in FIGS. 29-33 are illustrated in FIG. 40. Each of these sections 11 could be replaced by the section 11 of FIGS. 34-39.

Example materials for the sections 11 in all the embodiments herein include a plastic shell with a hollow core, Styrofoam, or a Styrofoam core with a plastic exterior. The plastic exterior can be formed by rotomold. Alternatively, a plastic sheet can be heated and vacuum fit to a mold. Styrofoam can be formed in a mold on top. The plastic can coat a bottom of each section, a surface of the core facing the holes 12, or both. Hollow plastic tubes can be inserted into each hole 12 for protection of the hole 12.

Example materials for the rods 22 include aluminum, stainless steel, or plastic. Example materials for the plates 261 include aluminum, stainless steel, or plastic.

What is claimed is:

1. A modular boat comprising:

two sections, each including a bow, a stern, a port, and a starboard;

a port of one of the sections adjacent to the starboard of the other section;

multiple pairs of holes, each pair including a hole from each of the two sections aligned with each other, each hole extending between port and starboard of the section it is in;

the pair of holes joining together at a junction, each junction including a protrusion surrounding an end of one of the holes inserted into and mating with a cavity surrounding an end of the other hole; and multiple rods, each extending through one of the pairs of holes, the rods being removable to allow separation of the sections.

2. The modular boat of claim 1, further comprising:

a back section having the same characteristics as the two sections;

the two sections include a front section and a side section;

the bow of all of the sections slope from a top to a bottom of the section, lengthening the section at the top and shortening the section at the bottom;

the stern of all of the sections slope from a bottom to a top of the section, lengthening the section at the bottom and shortening the section at the top;

the slope at the bow matches the slope at the stern;

the bow of the back section adjoins and mates with the stern of the front section, the back section and the front section forming a longitudinal pair;

the side section adjoins a side of both sections of the longitudinal pair; and one of the rods extends through holes of the front section and the side section and one of the rods extends through holes of the front section and the back section.

3. The modular boat of claim 2, wherein the top of each section is identical in shape with the bottom of each section.

4. The modular boat of claim 2, wherein the top of each section and the bottom of each section have a rectangular shape, offset longitudinally with respect to each other.

5. The modular boat of claim 1, further comprising:

a back section having the same characteristics as the two sections;

the two sections include a front section and a side section;

the bow of the front section, the side section, and the back section each has a convex shape;

the stern of the front section, the side section, and the back section each has a concave shape;

the convex shape matches the concave shape;

the bow of the back section adjoins and mates with the stern of the front section, the back section and the front section forming a longitudinal pair, and the side section adjoins a side of both sections of the longitudinal pair; and one of the rods extends through holes of the front section and the side section and one of the rods extends through holes of the front section and the back section.

6. The modular boat of claim 1, further comprising:

each rod has a locking-rod-end including three sides, the rod is capable of shortening its length, pulling the locking-rod-end and an opposite end towards each other, and pressing the two sections of the modular boat together, by rotating the opposite end;

each hole has a locking-hole-end including three sides; and the three sides of the locking-hole-end is capable of mating with the three sides of the locking-rod-end and holding the locking-rod-end of the rod in place while the opposite end rotates.

7. A modular boat comprising:

two sections, each including a bow, a stern, a port, and a starboard;

a port of one of the sections adjacent to the starboard of the other section;

multiple pairs of holes, each pair including a hole from each of the two sections aligned with each other, each hole extending between port and starboard of the section it is in;

multiple rods, each rod extending through one of the pairs of holes, the rods being removable to allow separation of the sections;

each rod has a locking-rod-end including three sides, the rod is capable of shortening its length, pulling the locking-rod-end and an opposite end towards each other, and pressing the two sections of the modular boat together;

each hole has a locking-hole-end including three sides; and the three sides of the locking-hole-end is capable of mating with the three sides of the locking-rod-end and holding the locking-rod-end of the rod in place while the opposite end rotates.

8. The modular boat of claim 7, wherein the rod is capable of shortening its length by rotating the opposite end.

9. The modular boat of claim 7, wherein the opposite end of each rod is a round-rod-end.

10. The modular boat of claim 9, wherein both ends of each hole is a locking-hole-end with three sides.

11. The modular boat of claim 7, wherein the locking-rod-end and the locking-hole-end each include six sides.

12. The modular boat of claim 7, wherein the sections are identical.

13. The modular boat of claim 7, further comprising:

a back section having the same characteristics as the two sections in claim 3;

the bow of the two sections and of the back section has a convex shape;

the stern of the two sections and of the back section has a concave shape;

the convex shape matches the concave shape;

the bow of the back section adjoins and mates with the stern of one of the two sections, defining a front section, the back section and the front section forming a longitudinal pair, and the other of the two sections, defining a side section, adjoins both sections of longitudinal pair; and one of the rods extends through holes of the front section and the side section and one of the rods extends through holes of the front section and the back section.

14. A removable roof rack for a modular boat with multiple sections capable of being joined between at the port and starboard sides by a rod extending through both sections, the removable roof rack comprising:

two separate plates, each plate comprising two sides opposite of each other, including an inner-face and an outer-face, the inner-faces of the plates facing each other;

a width of the sides is perpendicular to the ground;

a length of the sides is parallel to the ground;

$10 \leq W/Th$ and $25 \leq L/Th$, where Th is a thickness of each plate between the inner-face and the outer-face, W is the width of the sides, and L is the length of the sides;

multiple bars extending between the plates and attaching the plates to each other.

15. The rack of claim 14, further comprising the multiple sections of the modular boat between the plates of the roof rack and multiple rods holding the modular boat on the roof rack, each rod extending through a hole of each of sections.

16. The rack of claim 14, further comprising:

a series of rod-holes through each of the plates, the series being parallel to the ground;

the series of the separate plates are aligned with respect each other;

the rod-holes spaced and sized for holding equipment on the rack; and $15\ mm \leq D_{265} \leq 65\ mm$, where $D_{265}$ is a diameter of the rod-holes.

17. The rack of claim 14, further comprising:

three series of rod-holes through each of the plates, each series being parallel to the ground;

each of the series of the separate plates are aligned with respect each other;

the rod-holes spaced and sized for holding equipment on the rack; and $15\ mm \leq D_{265} \leq 65\ mm$, where $D_{265}$ is a diameter of the rod-holes.

18. The rack of claim 14, further comprising:

a series of rod-holes through each of the plates, the series being parallel to the ground; and $15\ mm \leq D_{265} \leq 65\ mm$, where $D_{265}$ is a diameter of the rod-holes.

19. The rack of claim 14, further comprising:

an edge-perimeter of each plate between the inner-face and the outer-face;

the edge-perimeter including (a) a bottom-edge facing down, (b) a top-edge facing up, and (c) two end-edges at opposite ends of the plate between and linking the bottom-edge and the top-edge;

a series of edge-holes, proximate the bottom-edge, proximate the top-edge, or both, the edge-holes sized and spaced for the multiple bars to be removably-attached to each plate and to connect the plates to each other.

20. The rack of claim 19, wherein the series of edge-holes have equal spacing between adjacent edge-holes, the spacing being a number between 15 mm and 100 mm.

* * * * *